US010565825B2

(12) United States Patent
Moret, Jr.

(10) Patent No.: US 10,565,825 B2
(45) Date of Patent: Feb. 18, 2020

(54) DOMINO WAGERING EVENT

(71) Applicant: Harold Moret, Jr., Los Angeles, CA (US)

(72) Inventor: Harold Moret, Jr., Los Angeles, CA (US)

( * ) Notice: Subject to any disclaimer, the term of this patent is extended or adjusted under 35 U.S.C. 154(b) by 0 days.

(21) Appl. No.: 16/032,511

(22) Filed: Jul. 11, 2018

(65) Prior Publication Data

US 2018/0374315 A1 Dec. 27, 2018

Related U.S. Application Data

(63) Continuation-in-part of application No. 15/633,755, filed on Jun. 27, 2017, now abandoned, and a continuation-in-part of application No. 15/890,300, filed on Feb. 6, 2018, and a continuation-in-part of application No. 15/956,653, filed on Apr. 18, 2018.

(51) Int. Cl.

| | |
|---|---|
| ***G07F 17/32*** | (2006.01) |
| ***A63F 9/20*** | (2006.01) |
| ***A63F 1/04*** | (2006.01) |
| ***A63F 3/00*** | (2006.01) |

(52) U.S. Cl.

CPC ..... *G07F 17/3288* (2013.01); *A63F 1/04* (2013.01); *A63F 3/00157* (2013.01); *A63F 9/20* (2013.01); *G07F 17/3244* (2013.01); *A63F 2001/0433* (2013.01)

(58) Field of Classification Search

USPC ..... 463/17

See application file for complete search history.

(56) References Cited

U.S. PATENT DOCUMENTS

| | | | | |
|---|---|---|---|---|
| 8,430,737 | B2 * | 4/2013 | Saunders | G07F 17/3211 463/16 |
| 2013/0023328 | A1 * | 1/2013 | Saunders | G07F 17/3211 463/20 |
| 2013/0023336 | A1 * | 1/2013 | Saunders | G07F 17/32 463/25 |
| 2013/0303259 | A1 * | 11/2013 | Saunders | G07F 17/34 463/20 |
| 2015/0024819 | A1 * | 1/2015 | Nicely | G07F 17/326 463/11 |

* cited by examiner

*Primary Examiner* — Pierre E Elisca

(74) *Attorney, Agent, or Firm* — Mark A. Litman & Associates, P.A.

(57) ABSTRACT

A method of executing a wagering event provides at least one and preferably two sets of twenty-eight domino tiles playing cards, each of the tiles or cards having two value areas on each face, the tile face values in each value area ranging from 0-6. Player positions are dealt at least three cards or tiles and a community card or tile is dealt to a center position. Each of the at least three cards is associated with the community card if there is a common value area, and value areas that form multiples of five (5) between the at least three tiles individually and the community card are determined and at least one wager is resolved against a paytable.

20 Claims, 12 Drawing Sheets

DOMINO WAGERING EVENT

RELATED APPLICATION DATA

This Application claims priority under 35 USC 120 as a continuation-in-part of U.S. patent application Ser. No. 15/956,653, filed 18 Apr. 2018 and titled Domino Wagering Event, which is in turn a continuation-in-part of U.S. patent application Ser. No. 15/890,300, filed 6 Feb. 2018 and titled DOMINO WAGERING EVENT, which in turn claims priority as a Continuation-in-Part from U.S. patent application Ser. No. 15/633,755, filed 27 Jun. 2017 and titled DOMINO WAGERING EVENT. which in turn claims priority from U.S. Provisional Patent Application Ser. No. 62/461,892, filed 22 Feb. 2017 and titled Domino Wagering Event.

BACKGROUND OF THE ART

1. Field of the Invention

The present invention relates to the field of wagering event, particularly wagering events on gaming tables or electronic wagering systems, and more particularly on wagering events using domino symbols in the form of physical or virtual tiles or cards.

2. Background of the Art

Domino games are very popular in various regions of the world. Domino games are particularly popular in the Caribbean and South and Central American countries.

Generally, domino games are played with a set of dominos. Each domino is a tile (generally a rectangular member) marked on one side with markings which represent value. Each domino has a pair or markings or two values. Generally, these marking comprise pips (usually circular dots).

The number of dominos used in a particular game may vary. For example, a set of dominos may comprise a collection of dominos marked with values 0-0 through 6-6. Each domino of the set is unique in that no other domino is marked with the same two values. The set of dominos comprises all combinations of potential values from the minimum to the maximum. Thus, in the set of dominos including the values 0-0 to 6-6, the set will include 28 dominos marked with the following values: 0-0, 0-1, 0-2, 0-3, 0-4, 0-5, 0-6, 1-1, 1-2, 1-3, 1-4, 1-5, 1-6, 2-2, 2-3, 2-4, 2-5, 2-6, 3-3, 3-4, 3-5, 3-6, 4-4, 4-5, 4-6, 5-5, 5-6 and 6-6. In other games, the set of dominos may include dominos marked with values up to 8-8 or even 12-12.

Beginning the Game by Setting the Heaviest Domino

In some domino games, the rules state that the first play must be made by the player with the highest double in his hand. Rules for other games state that the first play must be made by the player with the heaviest domino, double or single, as the case may be. Highest Double: After the tiles are shuffled, each player draws his hand from the stock. The player who draws the highest double of the set (i.e., double-9 if playing with a double-9 set), plays it as the lead. If the highest double was not drawn, the second highest double is played. If the second highest double was not drawn, the third highest double is played, and so on, until a double is played. If none of the players holds a double in his hand, all hands are discarded, reshuffled, and new hands are drawn. After the first player sets his double, the second play is made by the player to his left and play continues clockwise. Heaviest Tile: Follow the instructions above for "Highest Double" with this exception: Instead of drawing new hands if no player holds a double tile, the player holding the heaviest single begins play.

Winner of the Last Game: The winner of the last game played may open the next game. Or, if a game ends in a tie, the player who placed the last tile plays the first tile in the next game.

Drawing the Hand

Each player draws the number of tiles specified in the rules for the domino game being played and then places them in front of himself in such a way that the other players can't see the pips on his tiles.

After all hands have been drawn, there may be a surplus of tiles left in the stock. These tiles should remain face down, and, depending on the rules of the game being played, may be bought (See "Passing and Byeing" below.) later in that game.

Opening the Game

Determine who will make the first play, as explained above in "Order of Play" and according to the rules of the particular domino game being played. The player making the first play may be referred to as the setter, the downer, or the leader. He should place his tile face up in the middle of the table.

The words set, down, and lead are all used as verbs to refer to the act of making the first play of the game. "The set," "the down," and "the lead" are used as nouns to refer to the first domino played in a game and also the first play of the game. Here is a rule variation that players may agree to employ: Anytime a player plays a double, whether for the opening of the game or anytime thereafter during the game, he may immediately play a second tile onto his double before the next player makes his play.

Passing and Buying

Any player who does not hold a tile in his hand with the correct number of pips, and therefore cannot make the next play, must either pass or bye from the stock, according to the rules of the game. Some games permit players to skip a play if they so choose, even if they hold a playable tile.

Passing is also called knocking and renouncing. The player who is unable to make a play must announce to the other players, "I pass," and then the next player takes his turn. If no one is able to make a play, the game ends.

In some games buying tiles from the stock is allowed. In this case, a player draws the number of tiles he is permitted to take according to the rules of that game, adding them to the tiles he is holding in his hand. Once the player has drawn a tile he is able to play, he plays that domino.

There are many domino games that have the rule that all tiles in the stock may be bought, and there are others which have the rule that some tiles must be left in the stock and cannot be bought. In the case of the latter, the number of pips on the tiles left in the stock at the end of the game would be added to the winner's score.

Line of Play

There are many domino games that depend upon matching suits. In these games, the first player sets his domino, then the player to his left adds his tile to one of the free ends, and so on, going clockwise around the table with each player adding a tile. Players add tiles that have the matching number of pips with an open end of an already played tile.

As each player matches and plays a tile, a line is formed. This configuration of dominoes is called the layout, string, or line of play. In order to prevent tiles from falling off the table when the line of play extends too far, dominoes may be played in any direction. Regardless of the pattern of the line of play, the open end of the last domino played remains the same.

Dominoes are joined to the line of play in two ways: 1) with the line of play, lengthwise, the dominoes played end to end; or, 2) across the line of play, crosswise, the dominoes played across the matching number. In most domino games, doubles, and only doubles, are played crosswise; singles are played lengthwise, and the next tile is added after each double played, if the double is not a spinner, must be lengthwise.

Spinners

A spinner is a double which can be played on all four sides. Depending on the rules of the game being played, the double played as the lead is the only spinner of the game; or, every double played throughout the game is a spinner. If the double played is not a spinner, it may be played on only two sides.

Scoring

In some domino games, part of the score is obtained from the total number of pips at the ends of the line of play as the game progresses. If only one domino has been played, both ends of that domino are ends of the line of play. Thus, if a 5-5 tile is played, the count would be 10.

If two dominoes have been played, the count depends on whether both tiles are with the line of play or one tile is with and the other tile is across the line of play. For example, if the 3-5 and 5-1 tiles are played, the count is 4 (3+1). The matching halves of each of the two dominoes would be joined, end to end, with the open ends being 3 and 1. If the 3-5 and 5-5 tiles are played, the count is 13 (3+5+5). The double tile, 5-5, would be played across the line of play, and both halves of the double would be considered ends of the line of play.

Given the last example, if a tile is now played on the 5-5, assuming it is not a spinner, the 5-5 is no longer an end for the purpose of counting. See the example below. The line of play is 3-5, 5-5, 5-1, and the count is 4 (3+1). If the 5-5 is not a spinner in this case, the 5-5 is not an end.

In some domino games, a score is made only when the count of the ends of the line of play are a multiple of 5 or a multiple of 3, for example.

Another scoring method used in many domino games is to take the losing players' total number of pips by counting the pips on the tiles left in their hands at the end of a hand or the game and then adding that number to the winner's score.

End of the Game

Some domino games end once a certain number of hands have been played or a player or team makes the necessary points to win. For many other domino games, the object of the game is to be the first player (or team) to dispose of all the dominoes in your hand. These domino games end when a player has played all the dominoes in his hand before the other players and announces, "Domino." Sometimes none of the players are able to make another play. This is called a blocked game, and, in case the game is blocked and no one is able to make another play, the game would end.

Some efforts have been made in the literature to introduce wagering events based on dominos, but without significantly reports of commercial success.

Published US Patent Application Document No. 20040245723 (Davis) discloses a domino and dice game that includes a series of dominos having counts thereon which correspond to the possible counts generated by a pair of conventional cubical dice. The dominos are initially positioned face up, and the dice are tossed. Dominos having counts corresponding to the resulting count on the dice, are turned face down. Play continues by a single player until no more domino moves are possible, whereupon play transfers to the next player. Score is according to the number of dots displayed upon the remaining face up dominos after a turn is completed, with low score winning the round after all players have played. The present game also includes a playing box, with the box having at least one row of dominos pivotally secured thereacross and a dice tossing area. The playing box may include additional domino rows for doubles and blank dominos, if desired.

U.S. Pat. No. 4,125,263 (Hamilton) describes a game using two sets of dominos with twenty-eight dominos in each set. The sets are conventional, with the exception of markings indicating their additive or subtractive nature in play. The Hamilton game is played similarly to conventional domino play, but scoring may be accomplished by adding or subtracting dots of a domino at the end of a row, according to the additive or subtractive nature of the specific domino played. Hamilton does not disclose the use of dice to determine the manipulation of any of the dominos, nor does he provide a box or structure with dominos of varying denominations secured thereto, as is done with the present domino and dice game invention.

Published US Patent Application Document No. 20080230994 (Taranino) discloses a wager-based domino game suited for individual play, particularly as presented at a gaming machine. In accordance with the game, a player attempts to play one or more dominos. Various outcomes of game play are defined as losing. A number of outcomes are defined as winning and have associated awards, such as defined by a paytable. In one embodiment, winning outcomes may be awarded in the event a minimum number of dominos are played, or based upon a summed value of all dominos played. Domino-based bonus events offer a player additional winnings. The bonus events may be triggered by particular events of the wager-based domino game.

Published US Patent Application Document No. 20070278738 (Taranino) discloses a wager-based domino game is suited for individual play, particularly as presented at a gaming machine. In accordance with the game, a player attempts to play one or more dominos. Various outcomes of game play are defined as losing. A number of outcomes are defined as winning and have associated awards, such as defined by a paytable. In one embodiment, winning outcomes may be awarded in the event a minimum number of dominos are played, or based upon a summed value of all dominos played. Domino-based bonus events offer a player additional winnings. The bonus events may be triggered by particular events of the wager-based domino game.

The technology of the present invention may be executed on live table gaming formats with a dealer and physical tiles or special playing cards on a gaming table, on a completely electronic (on-line or video slot format) or on a blended system with physical cards or tiles and electronic wagering.

SUMMARY OF THE INVENTION

A method of and system for executing a domino tile including wagering event provides a set of multiples of twenty-eight domino tiles or domino playing cards, each of the tiles or cards having two value areas on each face. The tile face values in each value area range from 0-6. Player positions are dealt four cards or tiles and a community card or tile is dealt to a center position. Each of the four cards is associated with the community card if there is a common value area, and value areas that form multiples of five (5) between the four tiles individually (especially extending away from joined tile value areas) and the community card or community tile are determined and at least one wager is resolved against a paytable.

DETAILED DESCRIPTION OF THE INVENTION

Figure 1:
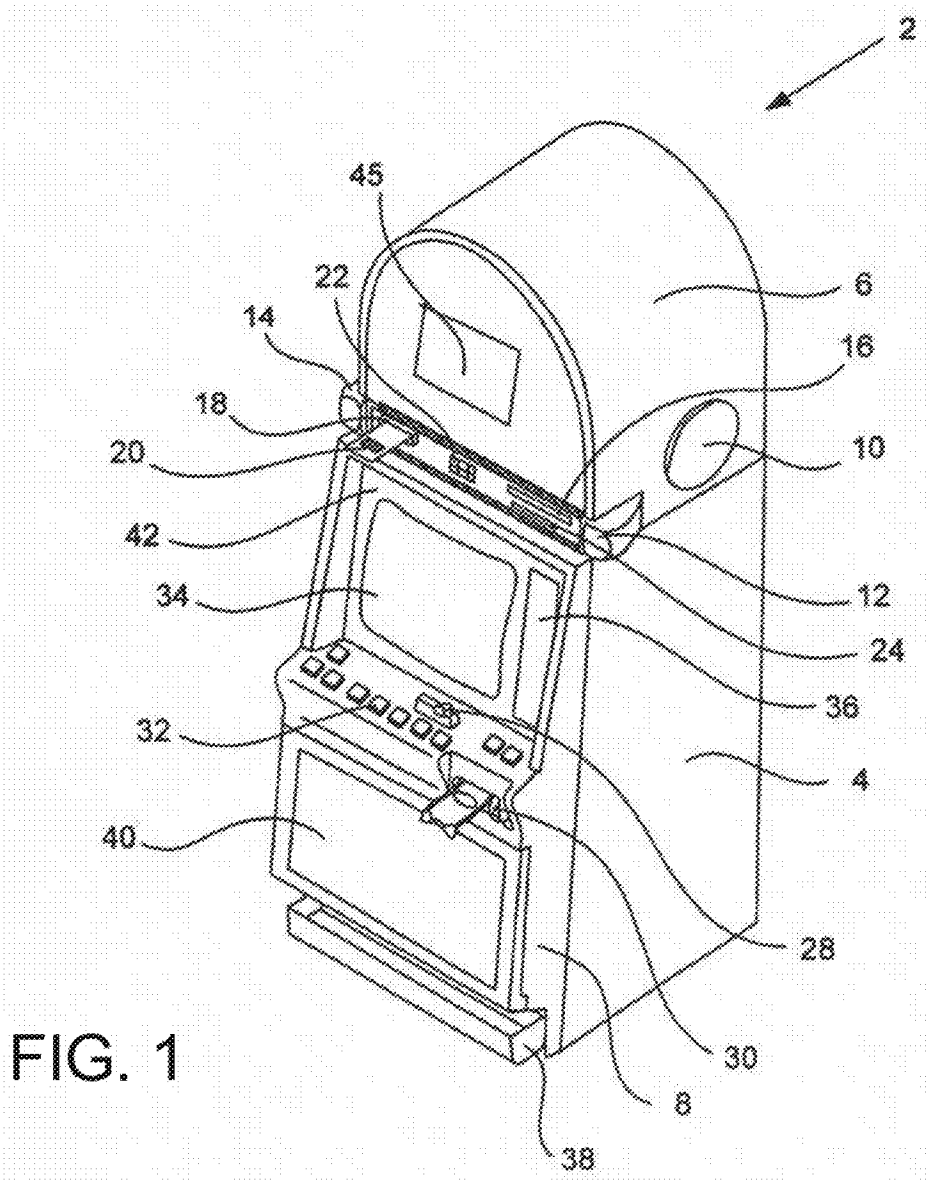
FIG. 1 shows an electronic gaming table on which the gaming method may be executed.

The present technology includes a method of executing a wagering event including providing at least one standard set of twenty-eight dominoes as domino tiles or domino playing cards each of the dominoes having two value areas on each face, the tile face values in each value area ranging from 0-6, the tiles have two areas with mixed values equally distributed with face values ranging from 0-0 to 6-6. A player position places a wager on a random outcome event by committing credit at a wagering position, the wager being against conformance between random outcome events with the dominoes with scoring events identified in a paytable.

The method provides a first random set of multiple dominoes, the player selecting only one of the first random set of multiple dominoes as a single core domino to be used in the execution of the wagering event. The method provides at least three random dominoes displayed to the player position that has made the wager as scoring dominoes. The method determines specific types of scoring combinations of dominoes between the single core domino and the at least three scoring dominoes and referencing a paytable chart that details all winning scoring combinations of the single core domino with the at least three scoring dominoes; and based on the determined winning scoring combinations, awarding the player position based on payouts in the paytable chart for the wager on the random outcome.

The first random set of multiple dominoes may consist of two or three random dominoes. The method uses at least two standard sets of twenty-eight dominoes and wherein awards to the player position are based on scoring combinations between the core domino and the scoring dominoes so that at least one set of compared values of at least one value area in a random core domino from the player position and at least one value area from the scoring dominoes, and remaining value areas of all scoring dominoes establish a collective value of values that are multiples of a specific values between 1 and 5. The at least two standard sets of twenty-eight dominoes may be provided as physical domino tiles or physical playing cards with domino tile face images and a dealer resolves the at least one wager by referencing a paytable chart. The at least two standard sets of twenty-eight domino tiles or domino playing cards are provided and wherein and wherein physical domino tiles or physical playing cards with domino tile face images are randomly distributed to the player position as the first set of three random dominoes and the scoring dominoes, and a dealer resolves the at least one wager by referencing a paytable chart and/or inputting tile of playing card displayed content into a processor which then evaluates all scoring activities in the paytable. The scoring activities may include determining if one or more collective values of multiples of 5 are formed by combinations of value areas between the core domino and the scoring dominoes. The dealer (which may be a virtual dealer such as a processor) awards credit to the player position based on the at least one wager against the paytable when at least two dominoes form multiples of five when combinations of value areas in the dominoes. A method may have a paytable indicates an award of credit based on at least one degree of correspondence among the core domino and the scoring dominoes which establish a collective value of multiples of 5, numbers of value areas establishing a collective value of multiples of 5 and specifically a 10 value, and numbers of value areas of all repositioned tiles excluding the at least one touching values establishes a collective value of multiples of 5, numbers of specifically 10 and 15, and totals of all configurations.

Another method of executing a wagering event on an electronic gaming system including a housing, a video display, a processor, memory, player input controls and a value-in-value-out system for entering credit into memory which can be used to place wagers through the player input controls selected from the group consisting of a) a ticket-in-ticket-out system having a ticket-reading scanner and ticket printer, and b) a currency validation system having a motor drive to advance currency past a scanner, the memory containing executable software that enables implementation of the wagering event with the wagering event including:

a player placing a wagering event through the player input controls accessing credit stored in memory that has been credited to the electronic gaming system through the value-in-value out system against a paytable based upon correspondence of random domino events as compared to the paytable;

the processor providing virtual images of a first random set of multiple dominoes to form a single core domino;

the player selecting through player input controls only one of the first random set of multiple dominoes as a single core virtual domino to be used in the execution of the wagering event, the selection made from memory of at least one standard set of twenty-eight virtual domino tiles or domino playing cards, each virtual domino having two value areas of from 0-6 on the two areas;

after the player selecting the single core virtual domino, the processor providing virtual images of a second random set of at least three virtual dominoes to form a set of at least three scoring dominoes;

the processor compares the single core domino to the second random set of scoring dominoes so that at least one compared one value area in the single core virtual domino and at least one value area from the second random set of at least three virtual dominoes are identical, and determining if any remaining value areas of all virtual dominoes establish a collective value of multiples of 5;

the processor evaluating all virtual dominoes to determine if one or more collective values of multiples of 5 are formed, and the processor retaining the at least one wager if no value areas of all virtual dominoes in the single virtual core domino and the at least three virtual dominoes establishes a collective value of multiples of 5; and the processor awarding credit to the processor based on the at least one wager against the paytable when evaluated dominoes are determined to have at least one collective value of multiples of 5.

The paytable identifies awards credit based on at least one degree of correspondence to the group of correspondence selected from the group consisting of numbers of dominoes establish a collective value of multiples of 5, or a collective value of multiples of 5 and specifically a 10 value, or a collective value of multiples of 5, numbers of specifically 10 and 15, and totals of all dominoes equaling a multiple of 5.

The method may be practiced wherein the at least two standard sets of twenty-eight domino tiles or domino playing cards are provided and wherein the sets of twenty-eight unique combinations of the two face values are provided as physical tiles or physical playing cards and resolution of the at least one wager is performed with physical reorientation of at least one of the at least three random scoring dominoes or domino playing cards with the core domino. The method may have the at least one wager is placed on a physical gaming tables, and domino tiles or domino playing cards are provided as the single random core domino and the at least three random scoring dominoes or domino playing cards from a physical randomization system. A second wager is placed against a second paytable, and awards on the second wager are based on at least two domino playing cards or domino tiles being doubles.

A system for performing and electronic wagering event may include an electronic gaming system with at least a housing, a video display, a processor, memory, player input controls and a value-in-value-out credit creation component for entering credit into memory which can be used to place wagers through the player input controls selected from the group consisting of a) a ticket-in-ticket-out system having a ticket-reading scanner and ticket printer, and b) a currency validation system having a motor drive to advance currency past a scanner, the memory containing executable software that enables implementation of the wagering event with steps including:

a player placing a wagering event through the player input controls accessing credit stored in memory that has been credited to the electronic gaming system through the value-in-value out system against a paytable based upon correspondence of random domino events as compared to the paytable;

the processor providing virtual images of a first random set of multiple dominoes to form a single core domino;

the player selecting through player input controls only one of the first random set of multiple dominoes as a single core virtual domino to be used in the execution of the wagering event, the selection made from memory of at least two standard sets of twenty-eight virtual domino tiles or domino playing cards, each virtual domino having two value areas of from 0-6 on the two areas;

after the player selecting the single core virtual domino, the processor providing virtual images of a second random set of at least three virtual dominoes to form a set of at least three scoring dominoes;

the processor compares the single core domino to the second random set of scoring dominoes so that at least one compared one value area in the single core virtual domino and at least one value area from the second random set of at least three virtual dominoes are identical, and determining if any remaining value areas of all virtual dominoes establish a collective value of multiples of 5;

the processor evaluating all virtual dominoes to determine if one or more collective values of multiples of 5 are formed, and the processor retaining the at least one wager if no value areas of all virtual dominoes in the single virtual core domino and the at least three virtual dominoes establishes a collective value of multiples of 5; and the processor awarding credit to the processor based on the at least one wager against the paytable when evaluated dominoes are determined to have at least one collective value of multiples of 5.

The paytable used by the processor to resolve wagers may define payout outs as:

| HAND | PAYS |
|---|---|
| Fitted Community Tile plus 4 | At least 100:1 up to 500:1 |
| 4 Fitted Tiles | At least 20:1 up to 50:1 |
| 3 Fitted Tiles | At least 4:1 up to 6:1 |
| 2 Fitted Tiles | At least 3:2 up to 3:1 |
| 1 or 0 Fitted Tiles | −1 |

One method of executing the wagering event of the present technology, which will first be described in terms of a physical wagering event at a gaming table using physical domino tiles or physical playing cards with card faces resembling domino tile faces is first described.

That method may include providing a standard set of multiples of twenty-eight (28) tiles or playing cards, each having two value areas on each face. The multiples, for example, could be 28, 56, 84, and 112 or more tiles or playing cards. The tile face values in each area range from 0-6, and the tiles have two areas with mixed values equally distributed (as with domino tiles) with face values ranging from 0-0, 0-1, 0-2 . . . 3-6, 4-6, 5-6 and 6-6. There is one tile with each combination of values, although random outcome frequencies can be adjusted (and payout rates adjusted) by eliminating some value sets and/or increasing numbers of certain tiles. In that modality, there would be at least 12 different cards in each 28-card set. Ordinarily, a standard set of dominoes has 14 non-repeating combinations of pips totaling 0-12, using exactly 0, 1, 2, 3, 4, 5 and 6 on each side of the tile or playing card. By adjusting the pips and number of repeating tiles, odds can be adjusted. This is especially true using multiple sets of 28 tiles. For example, as the total counts of 5 and 10 are used to establish payout combinations, by increasing tiles with 6 and 2 pips on a side and reducing tiles with 4 and 5 pips on a side, higher paying 10 counts are reduced, making the outcomes more house friendly, even if 5 counts might be elevated.

The event is executed by a player position placing a wager on a random outcome event through player input controls on an electronic wagering system or by placing chips or coins or currency on a wagering position. The wager is against conformance between random outcome events with the tiles (or cards) with events identified in a paytable.

The dealer (or processor if virtual tiles are delivered) provides exactly three or exactly four or exactly five random physical domino symbols (cards or tiles) to each player position, each having two value areas on each face. Each tile displays values of from 0-6 on the each of the two areas as in standard domino tiles, to a player position that has made the at least one wager and one random virtual domino also having two value areas of from 0-6 to a center position on the game table.

Figure 7:
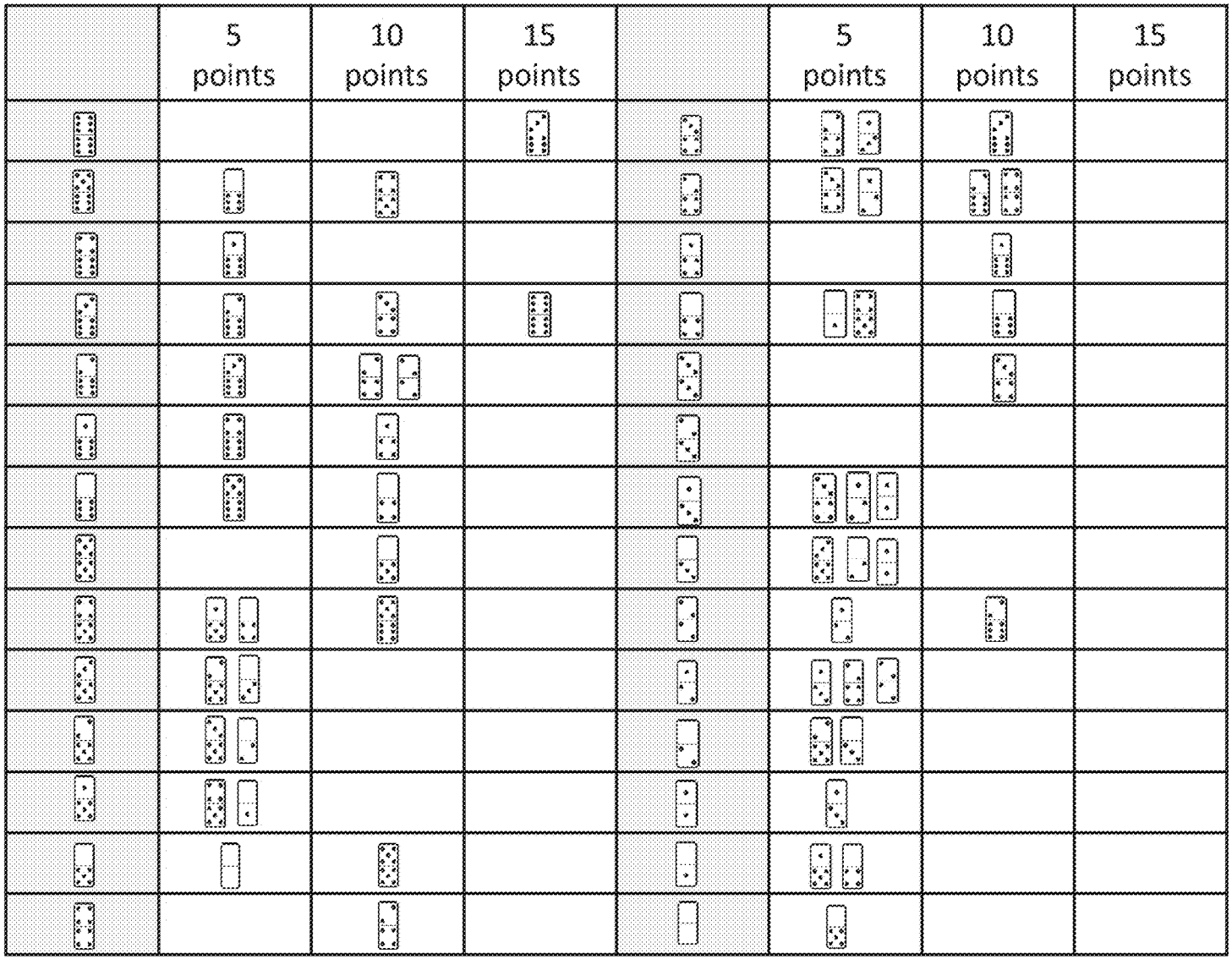
FIG. 7 shows a table representing domino combinations for every central domino and the point values (base 5) that can be formed with other remaining tiles or cards.

The dealer (real or virtual) determines specific types of combinations of tiles in relationships between the single center tile and the four dealer position tiles. The dealer can reference a paytable chart that details all winning combinations of individual tiles (using the four player position tiles) with the center domino tile. A typical dealer-referenced card for identification of winning tile combinations is shown in FIG. 7.

The payouts are based on potential or actual effects of repositioning at least one of the four random virtual dominos so that at least one set of touching values of at least one value area in a random virtual domino from the player position and at least one value area from the random virtual tile from the center area are identical, and remaining value areas of all repositioned tiles excluding the at least one touching values establishes a collective value of values that are multiples of a specific value such as 0, 1, 2, 3, 4 or especially 5 (which will be used in all examples discussed).

Using the dealer-referenced card, a processor or dealer evaluates all actual or theoretically repositioned tiles to determine if one or more collective values of multiples of 5 are formed by remaining value areas excluding the at least one touching values, and the processor retaining the at least one wager if no remaining value areas of all repositioned tiles excluding the at least one touching values establishes a collective value of multiples of 5. The dealer or processor awards credit to the processor based on the at least one wager against the paytable when the at least one wager if no remaining value areas of all repositioned tiles excluding the at least one touching values establishes a collective value of multiples of 5. If none of the player's cards/tiles match up with the community card, the wager is immediately lost.

The paytable may award credit based on at least one degree of correspondence to the group of correspondence selected from the group consisting of numbers of remaining value areas of all repositioned tiles excluding the at least one actual or virtually touching values which established a collective value of multiples of 5, numbers of remaining value areas of all repositioned tiles excluding the at least one touching values establishes a collective value of multiples of 5 and specifically a 10 value, and numbers of remaining value areas of all repositioned tiles excluding the at least one touching values establishes a collective value of multiples of 5, numbers of specifically 10 and 15, and totals of all configurations of repositioned game tiles each equaling a multiple of 5. Each and every player's tile that matches with the community tile and the distal numbers/pips on the tiles create multiples of 5 will pay out according to a paytable.

An electronically implemented method would include executing a wagering event on an electronic gaming system comprising a housing, a video display, a processor, memory, player input controls and a value-in-value-out system for entering credit into memory which can be used to place wagers through the player input controls.

The wagering event could include:

a player placing a wagering event through the player input controls accessing credit stored in memory that has been credited to the electronic gaming system through the value-in-value out system against a paytable based upon correspondence of random domino events as compared to the paytable;

the processor randomly providing from memory three, four or five random virtual dominos, each having two value areas of from 0-6 on the two areas, to a player position and one random virtual domino having two value areas of from 0-6 to a center position on the video display;

the player controls are used to reposition at least one of the three, four or five random virtual dominos (although four will be used as an exemplary number throughout the examples and descriptions) so that at least one touching values of at least one value area in a random virtual domino from the player position and at least one value area from the random virtual tile from the center area are identical, and remaining value areas of all repositioned tiles excluding the at least one touching values establishes a collective value of multiples of 5;

the processor evaluating all repositioned tiles to determine if one or more collective values of multiples of 5 are formed by remaining value areas excluding the at least one touching values, and the processor retaining the at least one wager if no remaining value areas of all repositioned tiles excluding the at least one touching values establishes a collective value of multiples of 5; and the processor awarding credit to the processor based on the at least one wager against the paytable when the at least one wager if no remaining value areas of all repositioned tiles excluding the at least one touching values establishes a collective value of multiples of 5.

The method would also use paytable awards credit based on at least one degree of correspondence to the group of correspondence selected from the group consisting of numbers of remaining value areas of all repositioned tiles excluding the at least one touching values establishes a collective value of multiples of 5, numbers of remaining value areas of all repositioned tiles excluding the at least one touching values establishes a collective value of multiples of 5 and specifically a 10 value, and numbers of remaining value areas of all repositioned tiles excluding the at least one touching values establishes a collective value of multiples of 5, numbers of specifically 10 and 15, and totals of all configurations of repositioned game tiles each equaling a multiple of 5. The player input controls may include a touchscreen wherein the four player position random virtual dominos may be repositioned by touch-and-drag of individual dominos. The player input controls may also include a dedicated button on a panel of buttons that signals the processor to reposition individual ones of the four player position four random virtual dominos adjacent to the one random virtual center domino in a best possible scoring position. The player input controls may also include a dedicated button on a panel of buttons that signals the processor to reposition individual ones of the four player position four random virtual dominos adjacent to the one random virtual center domino in various possible scoring positions and the player input control enables a function to freeze each virtual random virtual domino so repositioned upon player command.

The electronic version (as indicated above) may also use a system in which the virtual tiles/cards do not have to be visually rearranged, but the processor implements the comparison through the dealer (processor) readable (dealer-referenced) card or paytable. The payouts, as with paylines on video slot machines, may be paid out without specific marking of events that paid out, or the player input controls may input for a display of the winning outcomes, or the processor may automatically display the winning outcomes on the video display.

Alternative Wagers

Players may make two separate wagers, one for underlying Casino Dominoes game described above and one for a "Doubles Side Bet." The Doubles side bet wager is optional. The underlying wagering event referred to herein as "Casino Dominoes" game in which each player position or one communal player position is dealt four random cards from a specialty dominoes playing card deck in which twenty-eight cards, each card having a unique one of the twenty-eight possible combinations of two value area values of 0, 1, 2, 3, 4, 5 and 6. The cards are dealt face up to the player and community card is dealt face up in the center of the table. No additional cards will be drawn for the remainder of the hand. Players must have at least one value area matching at least one value area on the card in the center position (this is called matching one or more of the four cards with the community card) and either contacting value areas or non-contacting value areas must score in multiples of a digit (between 1, 2, 3, 4 and 5) that is preferably five. (either 5, 10, or 15). The scoring method follows the rules of a traditional and popular dominoes variation often referred to as Muggings or All Five.

After all four (three, five, six, seven and more are of course possibilities) of the player's cards are assessed against the community card, any qualifying cards that scores a value of either 5, 10, or 15 are summed together to form the final player point total. If the final player point total is 5 or greater according to this assessment, the player wins and is paid according to a paytable.

Figure 8:
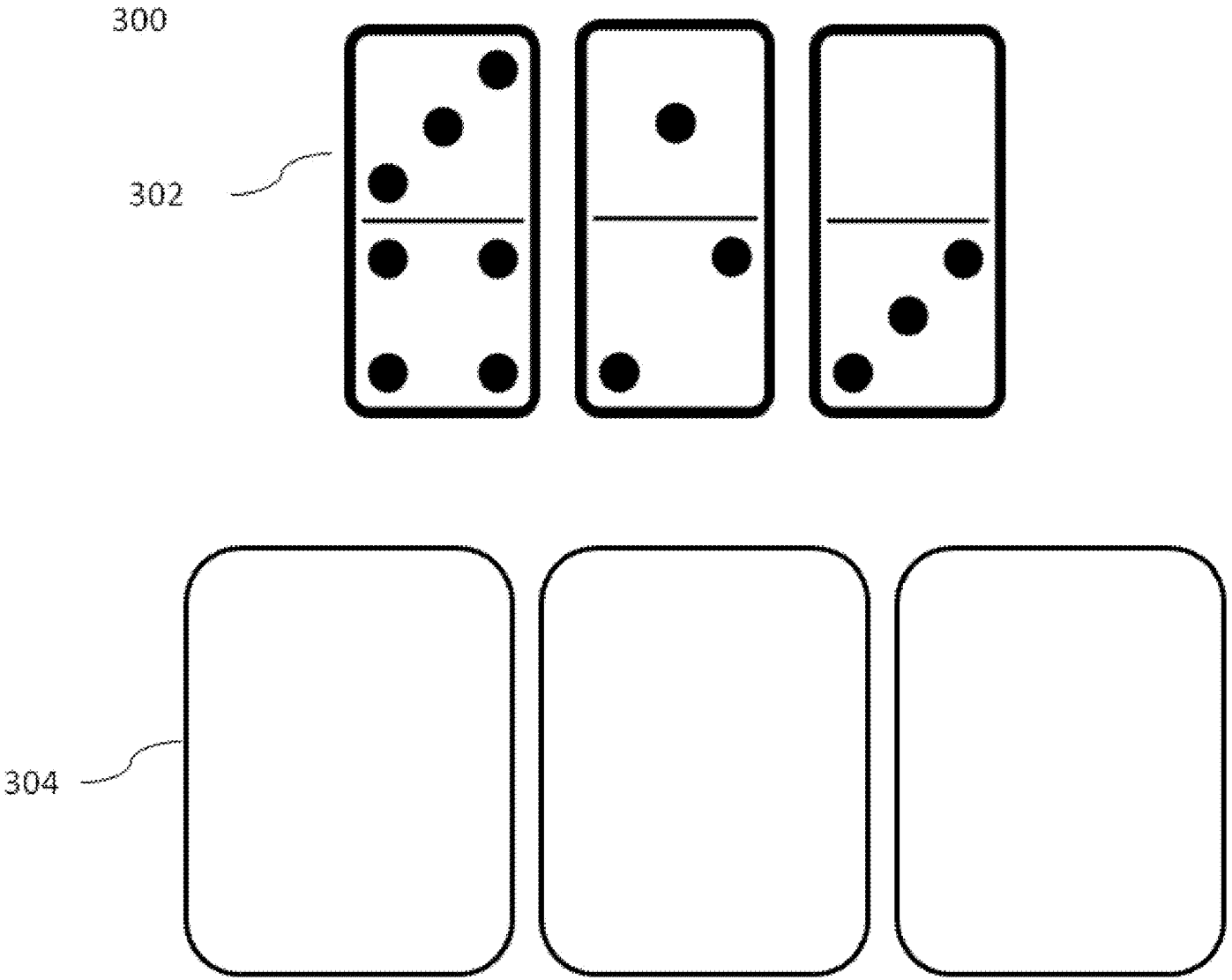
FIG. 8 show a first screen shot where a core domino is to be selected from a first set of three dominoes.

Each community card (center position card) has a limited number of cards that can score with it. The table in FIG. 8 shows all of the tiles that produce a score of 5, 10, or 15 for each of the 28 possible community tiles. Because of the limited number of cards that can play with each community card, it is possible to create a specialty deck with a reference table or dealer reference that lists each corresponding card(s) that scores with all 28 cards in the deck. For example, if the community card is a 4-0, there are three cards that score off of it (1-0; 5-4; 6-0). Those three cards are printed in the margins of the 4-0 card to make it easier for both the dealer and the player to identify the scoring cards (and the value of those winning cards).

This information (the only matching cards) can be printed into the margins of each card, so that the game becomes easier to learn and the dealer is much less likely to make an error in either the house's or player's advantage.

The doubles wager pays players if at least two or more of the four player-position cards or tiles are doubles. If all four of the player's tiles are doubles, a bonus payout can be achieved if the community card is also a double.

Two separate wagers played with a specialty deck of domino playing cards (or domino tiles).

Casino Dominoes is a derivation of traditional muggings dominoes where players try to score points of 5, 10, or 15 using specific scoring rules.

Doubles Side Bet: Based on how many doubles tiles are in the players hand.

Because of the limited number of cards that can play with each community card, it is possible to create a specialty deck that lists each corresponding card(s) that scores with all 28 cards in the deck.

For example, if the community card is a 4-0 there are three cards that score off of it (1-0; 5-4; 6-0). The values of those three cards are printed in the margins of the 4-0 card to make it easier for both the dealer and the player to identify the scoring cards (and the value of those winning cards).

By printing this information into the margins of each card, the game becomes easier to learn and the dealer is much less likely to make an error in either the house's or player's advantage.

The technology may be performed in various electronic modes. Turning next to FIG. 1, a video gaming machine 2 of the present invention is shown. Machine 2 includes a main cabinet 4, which generally surrounds the machine interior (not shown) and is viewable by users. The main cabinet includes a main door 8 on the front of the machine, which opens to provide access to the interior of the machine. Attached to the main door are player-input switches or buttons 32, a coin acceptor 28, and a bill validator 30, a coin tray 38, and a display area including a mechanical gaming system (or less preferably a separate electronic game) 40. There may be an overlay of touchscreen functionality on the separate electronic game 40 or some of the buttons 32 may be functional on the separate mechanical gaming system 40. That separate mechanical gaming system may be in a relatively vertical viewing position as shown or in a more horizontal (table like) display unit. Viewable through the main door is a video display monitor 34 and an information panel 36. The display monitor 34 will typically be a cathode ray tube, high resolution flat-panel LCD, LED, plasma screen or other conventional electronically controlled video monitor. The information panel 36 may be a back-lit, silk screened glass panel with lettering to indicate general game information including, for example, a game denomination (e.g. $0.25 or $1). The bill validator 30, player-input switches 32, video display monitor 34, and information panel are devices used to play a game on the game machine 2. The devices are controlled by circuitry (e.g. the master gaming controller) housed inside the main cabinet 4 of the machine 2.

Many different types of games, including mechanical slot games, video slot games, video poker, video black jack, video pachinko and lottery, may be provided with gaming machines of this invention. In particular, the gaming machine 2 may be operable to provide a play of many different instances of games of chance. The instances may be differentiated according to themes, sounds, graphics, type of game (e.g., slot game vs. card game), denomination, number of paylines, maximum jackpot, progressive or non-progressive, bonus games, etc. The gaming machine 2 may be operable to allow a player to select a game of chance to play from a plurality of instances available on the gaming machine. For example, the gaming machine may provide a menu with a list of the instances of games that are available for play on the gaming machine and a player may be able to select from the list a first instance of a game of chance that they wish to play.

The various instances of games available for play on the gaming machine 2 may be stored as game software on a mass storage device in the gaming machine or may be generated on a remote gaming device but then displayed on the gaming machine. The gaming machine 2 may executed game software, such as but not limited to video streaming software that allows the game to be displayed on the gaming machine. When an instance is stored on the gaming machine 2, it may be loaded from the mass storage device into a RAM for execution. In some cases, after a selection of an instance, the game software that allows the selected instance to be generated may be downloaded from a remote gaming device, such as another gaming machine.

The gaming machine 2 includes a top box 6, which sits on top of the main cabinet 4. The top box 6 houses a number of devices, which may be used to add features to a game being played on the gaming machine 2, including speakers 10, 12, 14, a ticket printer 18 which prints bar-coded tickets 20, a key pad 22 for entering player tracking information, a florescent display 16 for displaying player tracking information, a card reader 24 for entering a magnetic striped card containing player tracking information, and a video display screen 42. The ticket printer 18 may be used to print tickets for a cashless ticketing system. Further, the top box 6 may house different or additional devices than shown in the FIG. 1. For example, the top box may contain a bonus wheel or a back-lit silk-screened panel which may be used to add bonus features to the game being played on the gaming machine. As another example, the top box may contain a display for a progressive jackpot offered on the gaming machine. During a game, these devices are controlled and powered, in part, by circuitry (e.g. a master gaming controller) housed within the main cabinet 4 of the machine 2.

Understand that gaming machine 2 is but one example from a wide range of gaming machine designs on which the present invention may be implemented. For example, not all suitable gaming machines have top boxes or player tracking features. Further, some gaming machines have only a single game display—mechanical or video, while others are designed for bar tables and have displays that face upwards. As another example, a game may be generated in on a host computer and may be displayed on a remote terminal or a remote gaming device. The remote gaming device may be connected to the host computer via a network of some type such as a local area network, a wide area network, an intranet or the Internet. The remote gaming device may be a portable gaming device such as but not limited to a cell phone, a personal digital assistant, and a wireless game player. Images rendered from 3-D gaming environments may be displayed on portable gaming devices that are used to play a game of chance. Further a gaming machine or server may include gaming logic for commanding a remote gaming device to render an image from a virtual camera in a 3-D gaming environment stored on the remote gaming device and to display the rendered image on a display located on the remote gaming device. Thus, those of skill in the art will understand that the present invention, as described below, can be deployed on most any gaming machine now available or hereafter developed.

Some preferred gaming machines are implemented with special features and/or additional circuitry that differentiates them from general-purpose computers (e.g., desktop PC's and laptops). Gaming machines are highly regulated to ensure fairness and, in many cases, gaming machines are operable to dispense monetary awards of multiple millions of dollars. Therefore, to satisfy security and regulatory requirements in a gaming environment, hardware and software architectures may be implemented in gaming machines that differ significantly from those of general-purpose computers. A description of gaming machines relative to general-purpose computing machines and some examples of the additional (or different) components and features found in gaming machines are described below.

At first glance, one might think that adapting PC technologies to the gaming industry would be a simple proposition because both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

For the purposes of illustration, a few differences between PC systems and gaming systems will be described. A first difference between gaming machines and common PC based computers systems is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and, before the award could be provided to the player the power failed, the gaming machine, upon the restoration of power, would return to the state where the award is indicated. As anyone who has used a PC, knows, PCs are not state machines and a majority of data is usually lost when a malfunction occurs. This requirement affects the software and hardware design on a gaming machine.

A second important difference between gaming machines and common PC based computer systems is that for regulation purposes, the software on the gaming machine used to generate the game of chance and operate the gaming machine has been designed to be static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of volatile memory. The coding instructions on the EPROM are static (non-changeable) and must be approved by gaming regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaming jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator or player of a gaming machine from manipulating hardware and software in a manner that gives them an unfair and some cases an illegal advantage. The gaming machine should have a means to determine if the code it will execute is valid. If the code is not valid, the gaming machine must have a means to prevent the code from being executed. The code validation requirements in the gaming industry affect both hardware and software designs on gaming machines.

A third important difference between gaming machines and common PC based computer systems is the number and kinds of peripheral devices used on a gaming machine are not as great as on PC based computer systems. Traditionally, in the gaming industry, gaming machines have been relatively simple in the sense that the number of peripheral devices and the number of functions the gaming machine has been limited. Further, in operation, the functionality of gaming machines were relatively constant once the gaming machine was deployed, i.e., new peripherals devices and new gaining software were infrequently added to the gaming machine. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming machine, gaming machines still have unique device requirements that differ from a PC, such as device security requirements not usually addressed by PCs. For instance, monetary devices, such as coin dispensers, bill validators and ticket printers and computing devices that are used to govern the input and output of cash to a gaming machine have security requirements that are not typically addressed in PCs. Therefore, many PC techniques and methods developed to facilitate device connectivity and device compatibility do not address the emphasis placed on security in the gaming industry.

To address some of the issues described above, a number of hardware/software components and architectures are utilized in gaming machines that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

A watchdog timer is normally used in gaming machines to provide a software failure detection mechanism. In a normally operating system, the operating software periodically accesses control registers in the watchdog tinier subsystem to "re-trigger" the watchdog. Should the operating software fail to access the control registers within a preset timeframe, the watchdog timer will timeout and generate a system reset. Typical watchdog timer circuits contain a loadable timeout counter register to allow the operating software to set the timeout interval within a certain range of time. A differentiating feature of the some preferred circuits is that the operating software cannot completely disable the function of the watchdog timer. In other words, the watchdog timer always functions from the time power is applied to the board.

Gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modern general-purpose computers include voltage monitoring circuitry, these types of circuits only report: voltage status to the operating software. Out of tolerance voltages can cause software malfunction, creating a potential uncontrolled condition in the gaming computer. Gaming machines typically have power supplies with tighter voltage margins than that required by the operating circuitry. In addition, the voltage monitoring circuitry implemented in gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for slot machine game software is to use a state machine. Different functions of the game (bet, play, result, points in the graphical presentation, etc.) may be defined as a state. When a game moves from one state to another, critical data regarding the game software is stored in a custom non-volatile memory subsystem. This is critical to ensure the player's wager and credits are preserved and to minimize potential disputes in the event of a malfunction on the gaming machine.

In general, the gaming machine does not advance from a first state to a second state until critical information that allows the first state to be reconstructed is stored. This feature allows the game to recover operation to the current state of play in the event of a malfunction, loss of power, etc. that occurred just prior to the malfunction. After the state of the gaming machine is restored during the play of a game of chance, game play may resume and the game may be completed in a manner that is no different than if the malfunction had not occurred. Typically, battery backed RAM devices are used to preserve this critical data although other types of non-volatile memory devices may be employed. These memory devices are not used in typical general-purpose computers.

As described in the preceding paragraph, when a malfunction occurs during a game of chance, the gaming machine may be restored to a state in the game of chance just prior to when the malfunction occurred. The restored state may include metering information and graphical information that was displayed on the gaming machine in the state prior to the malfunction. For example, when the malfunction occurs during the play of a card game after the cards have been dealt, the gaming machine may be restored with the cards that were previously displayed as part of the card game. As another example, a bonus game may be triggered during the play of a game of chance where a player is required to make a number of selections on a video display screen. When a malfunction has occurred after the player has made one or more selections, the gaming machine may be restored to a state that shows the graphical presentation at the just prior to the malfunction including an indication of selections that have already been made by the player. In general, the gaming machine may be restored to any state in a plurality of states that occur in the game of chance that occurs while the game of chance is played or to states that occur between the play of a game of chance.

Game history information regarding previous games played such as an amount wagered, the outcome of the game and so forth may also be stored in a non-volatile memory device. The information stored in the non-volatile memory may be detailed enough to reconstruct a portion of the graphical presentation that was previously presented on the gaming machine and the state of the gaming machine (e.g., credits) at the time the game of chance was played. The game history information may be utilized in the event of a dispute. For example, a player may decide that in a previous game of chance that they did not receive credit for an award that they believed they won. The game history information may be used to reconstruct the state of the gaming machine prior, during and/or after the disputed game to demonstrate whether the player was correct or not in their assertion.

Another feature of gaming machines, such as gaming computers, is that they often contain unique interfaces, including serial interfaces, to connect to specific subsystems internal and external to the slot machine. The serial devices may have electrical interface requirements that differ from the "standard" EIA 232 serial interfaces provided by general-purpose computers. These interfaces may include EIA 485, EIA 422, Fiber Optic Serial, optically coupled serial interfaces, current loop style serial interfaces, etc. In addition, to conserve serial interfaces internally in the slot machine, serial devices may be connected in a shared, daisy-chain fashion where multiple peripheral devices are connected to a single serial channel.

The serial interfaces may be used to transmit information using communication protocols that are unique to the gaming industry. For example, the Netplex™ system of IGT is a proprietary communication protocol used for serial communication between gaming devices. As another example, SAS is a communication protocol used to transmit information, such as metering information, from a gaming machine to a remote device. Often SAS is used in conjunction with a player tracking system.

Gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into a gaming machine by monitoring security switches attached to access doors in the slot machine cabinet. Preferably, access violations result in suspension of game play and can trigger additional security operations to preserve the current state of game play. These circuits also function when power is off by use of a battery backup. In power-off operation, these circuits continue to monitor the access doors of the slot machine. When power is restored, the gaming machine can determine whether any security violations occurred while power was off, e.g., via software for reading status registers. This can trigger event log entries and further data authentication operations by the slot machine software.

Trusted memory devices are preferably included in a gaining machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc. The purpose of these trusted memory devices is to provide gaming regulatory authorities a root trusted authority within the computing environment of the slot machine that can be tracked and verified as original. This may be accomplished via removal of the trusted memory device from the slot machine computer and verification of the secure memory device contents is a separate third party verification device. Once the trusted memory device is verified as authentic, and based on the approval of the verification algorithms contained in the trusted device, the gaming machine is allowed to verify the authenticity of additional code and data that may he located in the gaming computer assembly, such as code and data stored on hard disk drives. A few details related to trusted memory devices that may be used in the present invention are described in U.S. Pat. No. 6,685,567 titled "Process Verification," which is incorporated herein in its entirety and for all purposes.

Mass storage devices used in a general purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could he provided by software, gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present.

A method of hosting an underlying game or side bet wagering event during a game of tile-based play such as domino-type game may be executed on an electronic gaming machine, electronic gaming table or blended physical playing cards with electronic tile input and touchscreen. The electronic gaming machine may have a housing, player input control, video display including touchscreen sensitivity, processor, memory, and a value-in-value-out credit creation component selected from the group consisting of a) a ticket-in-ticket-out system having a ticket-reading scanner and ticket printer, and b) a currency validation system having a motor drive to advance currency past a scanner.

Returning to the example of FIG. 1, when a user wishes to play the gaming machine 2, he or she inserts cash through the coin acceptor 28 or bill validator 30. Additionally, the bill validator may accept a printed ticket voucher which may be accepted by the bill validator 30 as an indicia of credit when a cashless ticketing system is used. At the start of the game, the player may enter playing tracking information using the card reader 24, the keypad 22, and the florescent display 16. Further, other game preferences of the player playing the game may be read from a card inserted into the card reader. During the game, the player views game information using the video display 34. Other game and prize information may also be displayed in the video display screen 42 located in the top box.

During the course of a game, a player may be required to make a number of decisions, which affect the outcome of the game. For example, a player may vary his or her wager on a particular game, select a prize for a particular game selected from a prize server, or make game decisions which affect the outcome of a particular game. The player may make these choices using the player-input switches 32, the video display screen 34 or using some other device which enables a player to input information into the gaming machine. In some embodiments, the player may be able to access various game services such as concierge services and entertainment content services using the video display screen 34 and one more input devices.

During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 2 or from lights within the separate mechanical (or electronic) separately, individually wagerable gaming system 40. After the player has completed a game, the player may receive game tokens from the coin tray 38 or the ticket 20 from the printer 18, which may be used for further games or to redeem a prize. Further, the player may receive a ticket 20 for food, merchandise, or games from the printer 18.

Figure 1A:
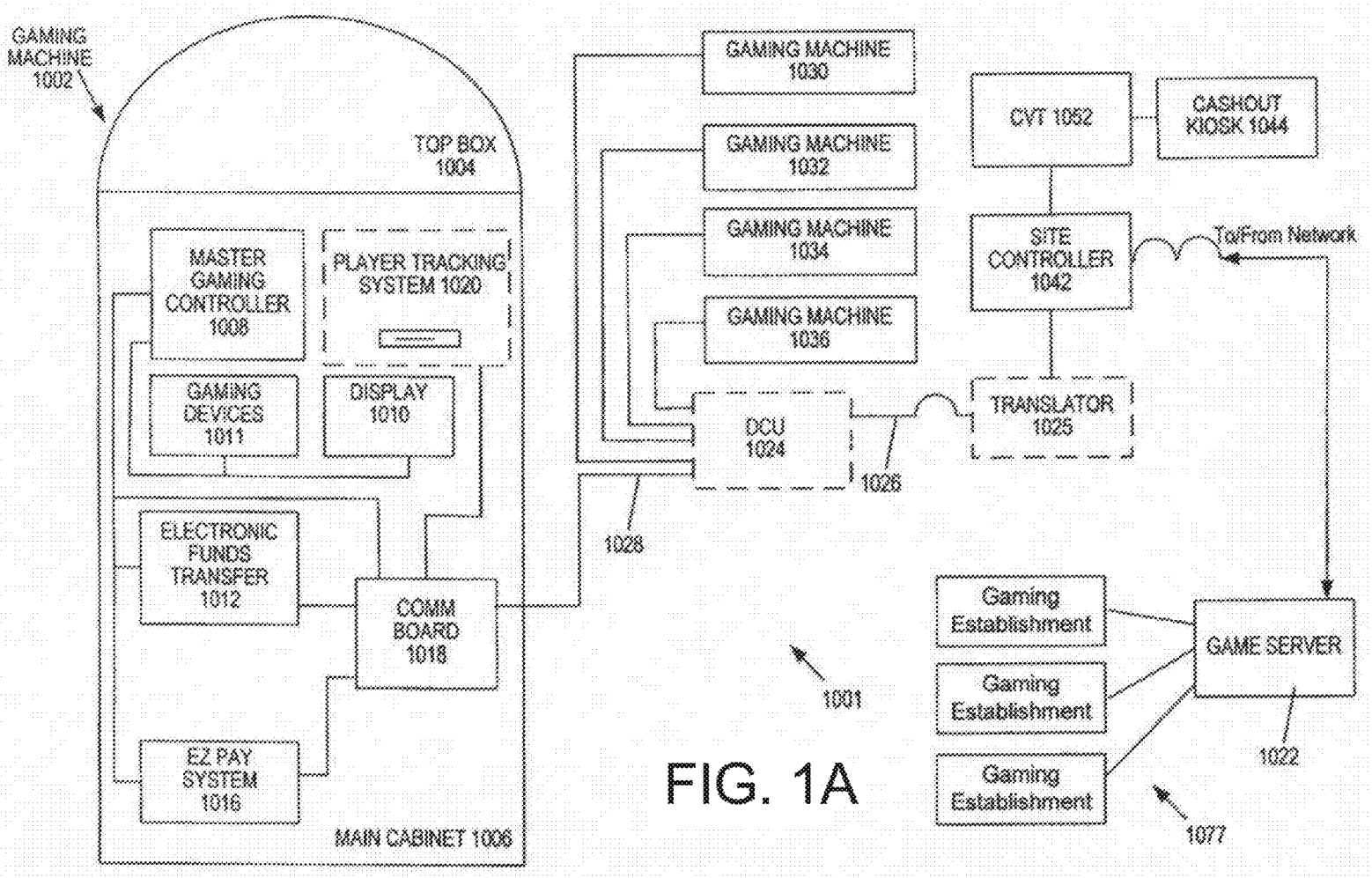
FIG. 1A shows a schematic for an electronic system for enabling play of the gaming method described herein.

Another gaming network that may be used to implement some aspects of the invention is depicted in FIG. 1A. Gaming establishment 1001 could be any sort of gaming establishment, such as a casino, a card room, an airport, a store, etc. In this example, gaming network 1077 includes more than one gaming establishment, all of which are networked to game server 1022.

Here, gaming machine 1002, and the other gaming machines 1030, 1032, 1034, and 1036, include a main cabinet 1006 and a top box 1004. The main cabinet 1006 houses the main gaming elements and can also house peripheral systems, such as those that utilize dedicated gaming networks. The top box 1004 may also be used to house these peripheral systems.

The master gaming controller 1008 controls the game play on the gaming machine 1002 according to instructions and/or game data from game server 1022 or stored within gaming machine 1002 and receives or sends data to various input/output devices 1011 on the gaming machine 1002. In one embodiment, master gaming controller 1008 includes processor(s) and other apparatus of the gaming machines described above. The master gaming controller 1008 may also communicate with a display 1010.

A particular gaming entity may desire to provide network gaming services that provide some operational advantage. Thus, dedicated networks may connect gaming machines to host servers that track the performance of gaming machines under the control of the entity, such as for accounting management, electronic fund transfers (EFTs), cashless ticketing, such as EZPay™, marketing management, and data tracking, such as player tracking. Therefore, master gaming controller 1008 may also communicate with EFT system 1012, EZPay™ system, and player tracking system 1020. The systems of the gaming machine 1002 communicate the data onto the network 1022 via a communication board 1018.

It will be appreciated by those of skill in the art that embodiments of the present invention could be implemented on a network with more or fewer elements than are depicted in FIG. 1A. For example, player tracking system 1020 is not a necessary feature of some implementations of the present invention. However, player tracking programs may help to sustain a game player's interest in additional game play during a visit to a gaming establishment and may entice a player to visit a gaming establishment to partake in various gaming activities. Player tracking programs provide rewards to players that typically correspond to the player's level of patronage (e.g., to the player's playing frequency and/or total amount of game plays at a given casino). Player tracking rewards may be free meals, free lodging and/or free entertainment. Player tracking information may be combined with other information that is now readily obtainable by an SBG system.

Moreover, DCU 1024 and translator 1025 are not required for all gaming establishments 1001. However, due to the sensitive nature of much of the information on a gaming network (e.g., electronic fund transfers and player tracking data) the manufacturer of a host system usually employs a particular networking language having proprietary protocols. For instance, 10-20 different companies produce player tracking host systems where each host system may use different protocols. These proprietary protocols are usually considered highly confidential and not released publicly.

Further, gaming machines are made by many different manufacturers. The communication protocols on the gaming machine are typically hard-wired into the gaming machine and each gaming machine manufacturer may utilize a different proprietary communication protocol. A gaming machine manufacturer may also produce host systems, in which case their gaming machines are compatible with their own host systems. However, in a heterogeneous gaming environment, gaming machines from different manufacturers, each with its own communication protocol, may be connected to host systems from other manufacturers, each with another communication protocol. Therefore, communication compatibility issues regarding the protocols used by the gaming machines in the system and protocols used by the host systems must be considered.

A network device that links a gaming establishment with another gaming establishment and/or a central system will sometimes be referred to herein as a "site controller." Here, site controller 1042 provides this function for gaming establishment 1001. Site controller 1042 is connected to a central system and/or other gaming establishments via one or more networks, which may be public or private networks. Among other things, site controller 1042 communicates with game server 1022 to obtain game data, such as ball drop data, bingo card data, etc.

In the present illustration, gaming machines 1002, 1030, 1032, 1034 and 1036 are connected to a dedicated gaming network 1022. In general, the DCU 1024 functions as an intermediary between the different gaming machines on the network 1022 and the site controller 1042. In general, the DCU 1024 receives data transmitted from the gaming machines and sends the data to the site controller 1042 over a transmission path 1026. In some instances, when the hardware interface used by the gaming machine is not compatible with site controller 1042, a translator 1025 may be used to convert serial data from the DCU 1024 to a format accepted by site controller 1042. The translator may provide this conversion service to a plurality of DCUs.

Further, in some dedicated gaming networks, the DCU 1024 can receive data transmitted from site controller 1042 for communication to the gaming machines on the gaming network. The received data may be, for example, communicated synchronously to the gaming machines on the gaming network.

Here, CVT 1052 provides cashless and cashout gaming services to the gaming machines in gaming establishment 1001. Broadly speaking, CVT 1052 authorizes and validates cashless gaming machine instruments (also referred to herein as "tickets" or "vouchers"), including but not limited to tickets for causing a gaming machine to display a game result and cash-out tickets. Moreover, CVT 1052 authorizes the exchange of a cashout ticket for cash. These processes will be described in detail below. In one example, when a player attempts to redeem a cash-out ticket for cash at cashout kiosk 1044, cash out kiosk 1044 reads validation data from the cashout ticket and transmits the validation data to CVT 1052 for validation. The tickets may be printed by gaming machines, by cashout kiosk 1044, by a stand-alone printer, by CVT 1052, etc. Some gaming establishments will not have a cashout kiosk 1044. Instead, a cashout ticket could be redeemed for cash by a cashier (e.g. of a convenience store), by a gaming machine or by a specially configured CVT.

Figure 1B:
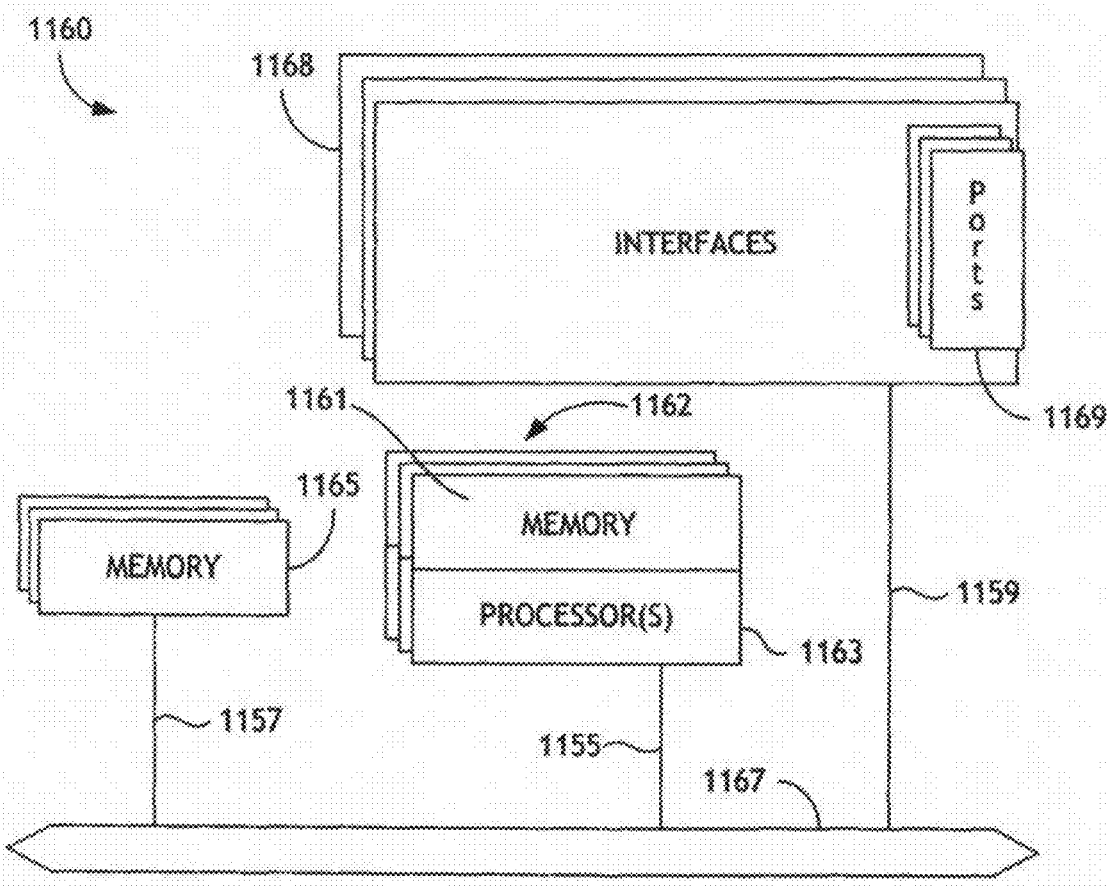
FIG. 1B shows another schematic for an electronic system for enabling play of the gaming method described herein.

FIG. 1B illustrates an example of a network device that may be configured for implementing some methods of the present invention. Network device 1160 includes a master central processing unit (CPU) 1162, interfaces 1168, and a bus 1167 (e.g., a PCI bus). Generally, interfaces 1168 include ports 1169 appropriate for communication with the appropriate media. In some embodiments, one or more of interfaces 1168 includes at least one independent processor and, in some instances, volatile RAM. The independent processors may be, for example, ASICs or any other appropriate processors. According to some such embodiments, these independent processors perform at least some of the functions of the logic described herein. In some embodiments, one or more of interfaces 1168 control such communications-intensive tasks as encryption, decryption, compression, decompression, packetization, media control and management. By providing separate processors for the communications-intensive tasks, interfaces 1168 allow the master microprocessor 1162 efficiently to perform other functions such as routing computations, network diagnostics, security functions, etc.

The interfaces 1168 are typically provided as interface cards (sometimes referred to as "linecards"). Generally, interfaces 1168 control the sending and receiving of data packets over the network and sometimes support other peripherals used with the network device 1160. Among the interfaces that may be provided are FC interfaces, Ethernet interfaces, frame relay interfaces, cable interfaces, DSL interfaces, token ring interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like.

When acting under the control of appropriate software or firmware, in some implementations of the invention CPU 1162 may be responsible for implementing specific functions associated with the functions of a desired network device. According to some embodiments, CPU 1162 accomplishes all these functions under the control of software including an operating system and any appropriate applications software.

CPU 1162 may include one or more processors 1163 such as a processor from the Motorola family of microprocessors or the MIPS family of microprocessors. In an alternative embodiment, processor 1163 is specially designed hardware for controlling the operations of network device 1160. In a specific embodiment, a memory 1161 (such as non-volatile RAM and/or ROM) also forms part of CPU 1162. However, there are many different ways in which memory could be coupled to the system. Memory block 1161 may be used for a variety of purposes such as, for example, caching and/or storing data, programming instructions, etc.

Regardless of network device's configuration, it may employ one or more memories or memory modules (such as, for example, memory block 1165) configured to store data, program instructions for the general-purpose network operations and/or other information relating to the functionality of the techniques described herein. The program instructions may control the operation of an operating system and/or one or more applications, for example.

Because such information and program instructions may be employed to implement the systems/methods described herein, the present invention relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher-level code that may be executed by the computer using an interpreter.

Although the system shown in FIG. 1B illustrates one specific network device of the present invention, it is by no means the only network device architecture on which the present invention can be implemented. For example, an architecture having a single processor that handles communications as well as routing computations, etc. is often used. Further, other types of interfaces and media could also be used with the network device. The communication path between interfaces may be bus based (as shown in FIG. 1B) or switch fabric based (such as a cross-bar).

Figure 2:
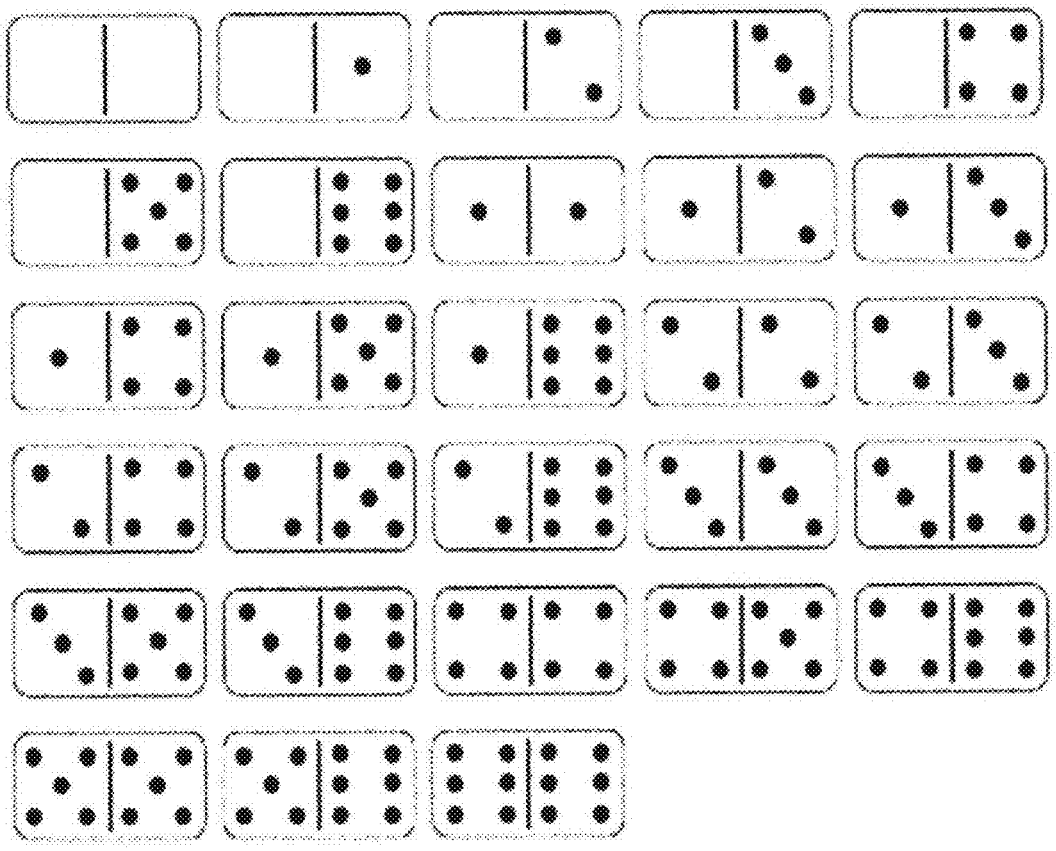
FIG. 2 shows a complete set of twenty-eight (28) domino tiles, which can be doubled to form the two-set forty-six (46) domino tile images on tiles or on playing cards.

FIG. 2 shows a complete set of twenty-eight (28) domino tiles, which can be doubled to form the two-set forty-six (46) domino tile images on tiles or on playing cards.

Figure 3:
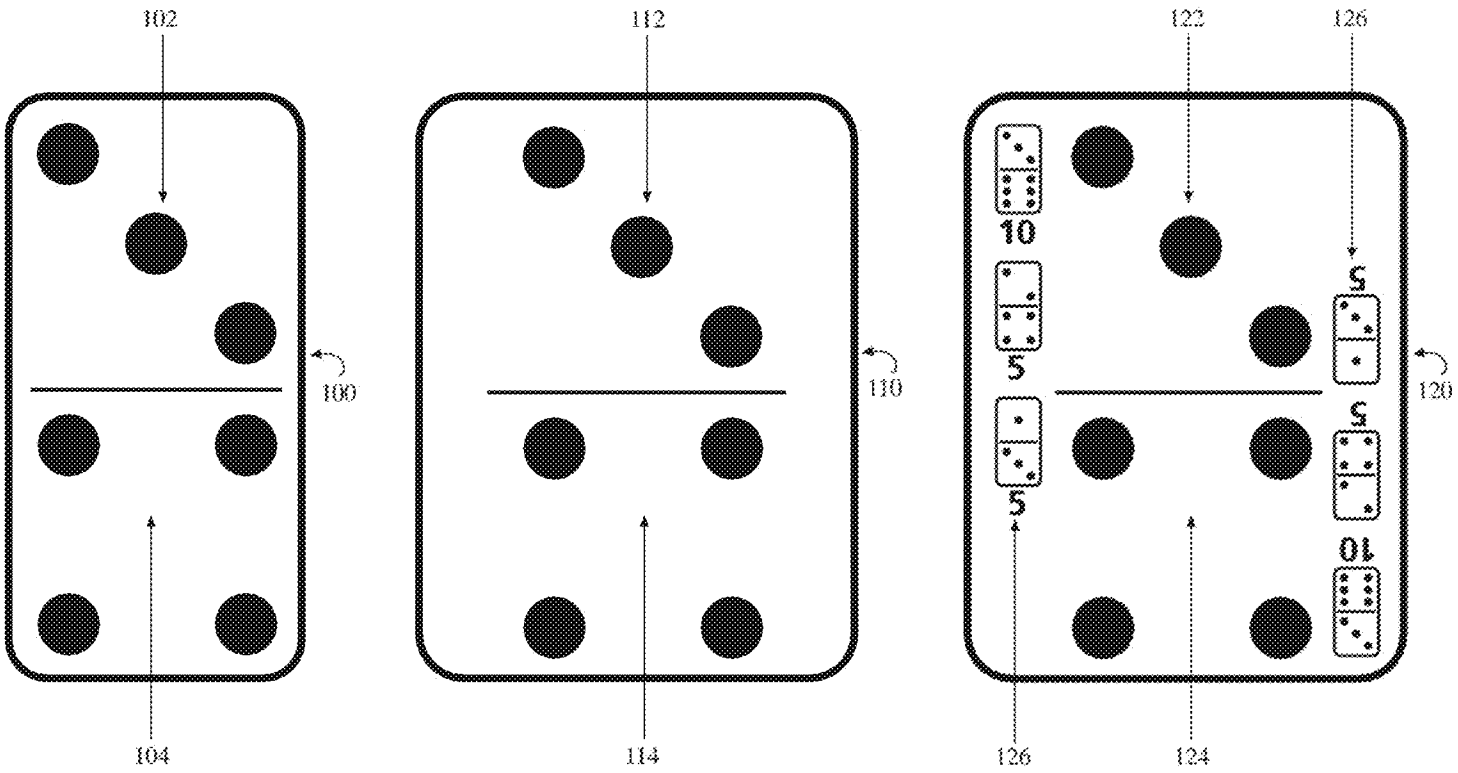
FIG. 3 shows three different tiles or cards that can be used in the present technology, the third card having printed thereon, for when the third tile is the single community card, all other single tiles with which that community tile forms winning combinations for multiple-5 counts and the number of point counts that specific tile will form with that community tile.

FIG. 3 shows three different dominoes (as domino tiles or domino cards) 100, 110 and 120 that can be used in the present technology, the third card 120 having printed thereon, for when the third tile 120 is the single community card, all other single tiles (not shown) with which that community tile forms winning combinations for multiple-5 counts and the number of point counts that specific tile will form with that community tile are identified as both individual cards 126 in the corner of card 120 as well as the points the tile 120 forms with that tile 126. For purposes of this invention, these markings 126 in the corner of cards 120 are defined as "point match card identifications." These individual dominoes (whether tiles, cards, physical or virtual) having both primary domino pips and point match card identifications are defined as point match indicating dominoes. Nominal "top" halves 102, 112 and 122 and nominal "bottom" halves 104, 114 and 124 of dominoes 100, 110 and 120 are shown.

Figure 4:
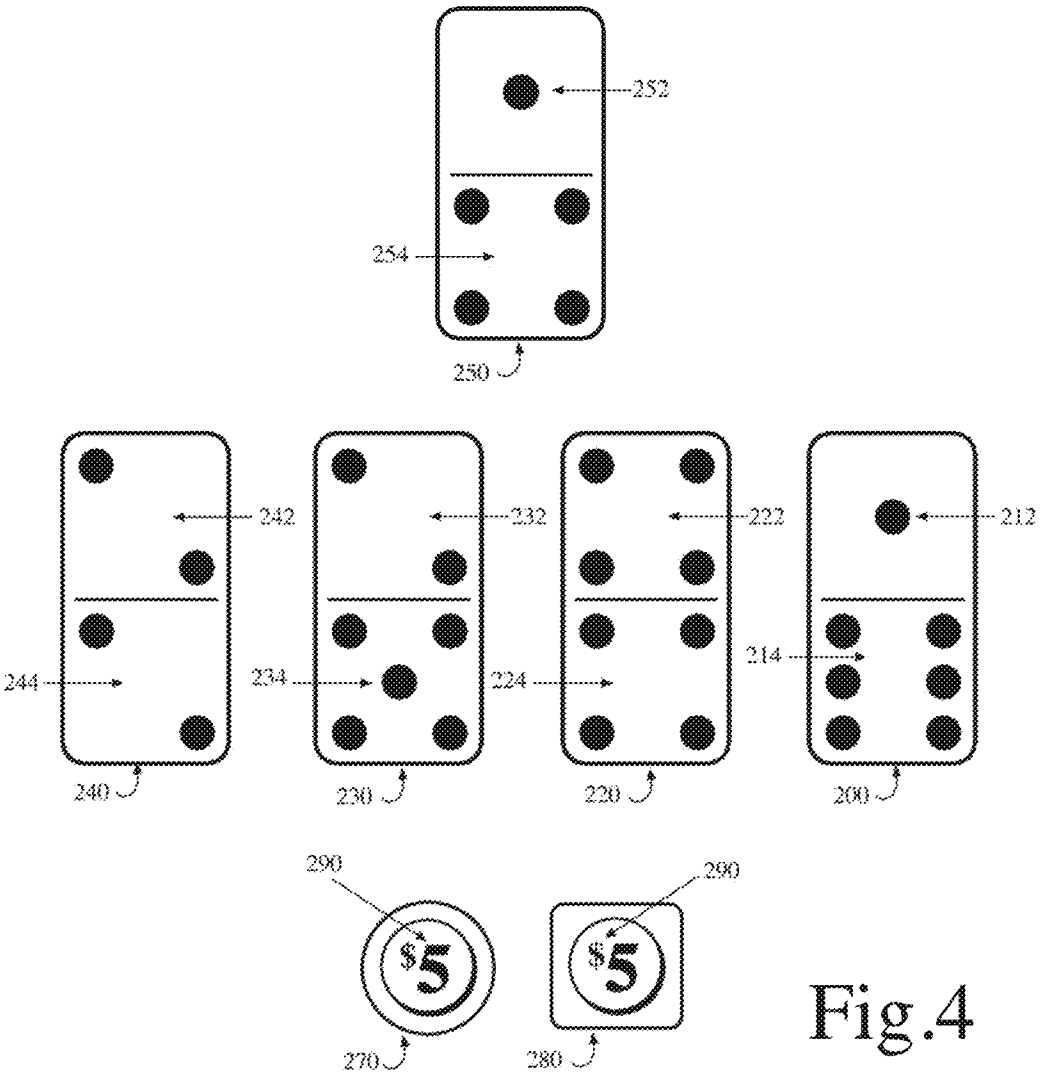
FIG. 4 shows one screen shot of a single community tile, four player hand tiles, and two $5.00 wagers, one on an underlying game and one on a bonus event.

FIG. 4 shows one screen shot of a single community tile 250 (the core domino), four player hand tiles (scoring tiles) 200, 220, 230 and 240 and two $5.00 wagers 290, one on an underlying game 270 and one on a bonus event 280. Nominal "top" halves 212, 222 and 232 and 242 and 252 and nominal "bottom" halves 214, 224, 234, 244 and 254 of dominoes 200, 220, 230, 240 and 250 are shown.

Figure 5:
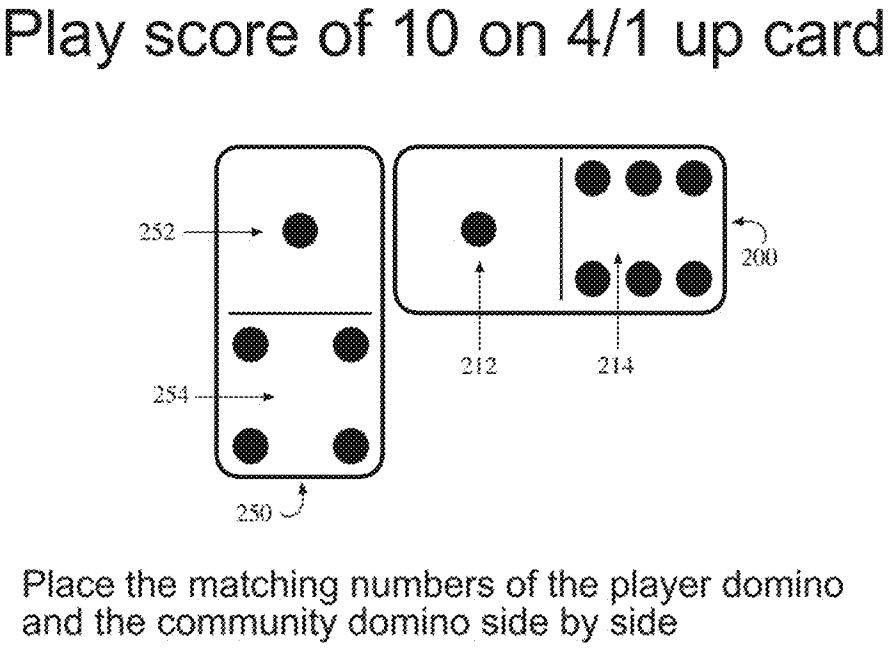
FIG. 5 shows how and why tiles are arranged to form a play score of 10 using the community tile and the fourth player tile of FIG. 4.

FIG. 5 shows how and why tiles (the core tile 250 and one scoring tile 200 are arranged to form a play score of 10 using the community tile and the fourth player tile of FIG. 4. All identical numbers in different figures represent identical elements.

Figure 6:
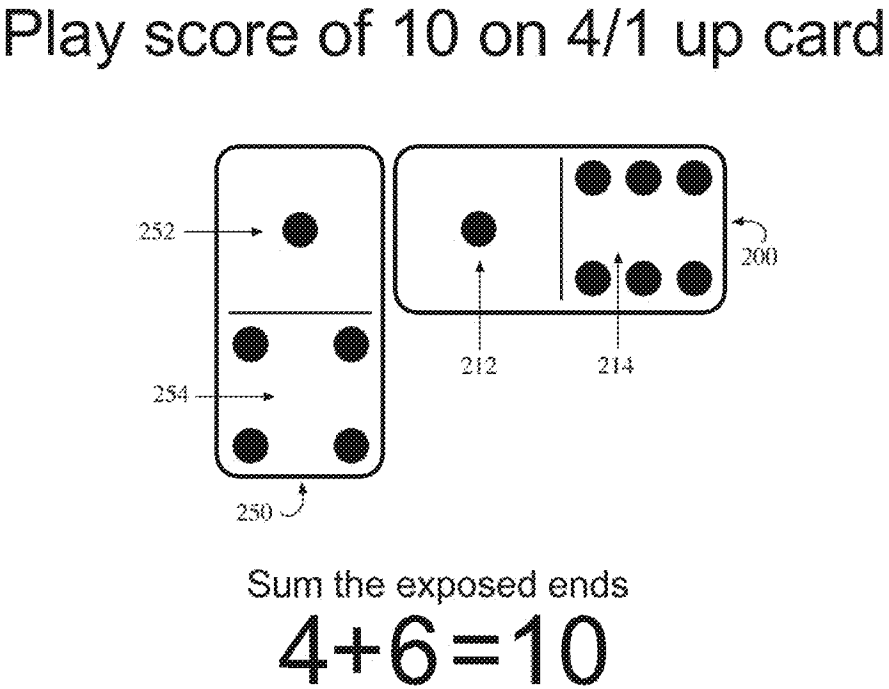
FIG. 6 shows a simplified screen from FIGS. 4 and 5 forming a play score of 10 using the community tile and the fourth player tile of FIG. 4.

FIG. 6 shows a simplified screen from FIGS. 4 and 5 forming a play score of 10 using the community tile and the fourth player tile of FIG. 4. All identical numbers in different figures represent identical elements.

FIG. 7 shows a table representing dice combinations for every central die and the point values (base 5) that can be formed with other remaining tiles or cards.

Primary Alternative Execution of Gaming Technology

Using essentially similar or even identical counting procedures, and using two similar of identical twenty-eight card decks, forming a fifty-six card playing deck, with each card with the image-content as in the original twenty-eight card decks, with the secondary markings indicating values or combinations of values on other cards that, when combined with the primary point markings on the cards, will establish winning points for the underlying game.

Each player is dealt at least three cards face up and their own individual connector card is dealt face up (connector replaces the community). Players must match at least one of their three hand cards to the connector to form a point value of 5, 10, or 15. All winning point values are added together to create the final total, on which points the winning amounts are based.

An (optional) rule that may be executed. If the player receives the 3-2 card as their connector, the hand is automatically worth 5 points.

In FIG. 8 a first screen shot 300 in the game progresses by dealing three random dominos/domino cards 302 (physical or virtual) from a physical or virtual deck of at least 28 unique ranks (and preferably sets of multiples of those 28 unique ranks).

The player then selects (must choose) to keep exactly one of the dominoes/domino cards (physical or virtual) and discard the other two. Then an additional at least three random dominoes are provided intro positions 304 as part of the gaming event. The goal is to pair the selected domino with one, two, or all three of the unrevealed dominoes in the row below using traditional all-fives dominos scoring.

The player must use strategy to select the domino that pairs with other dominoes more frequently and for bigger values.

Figure 9:
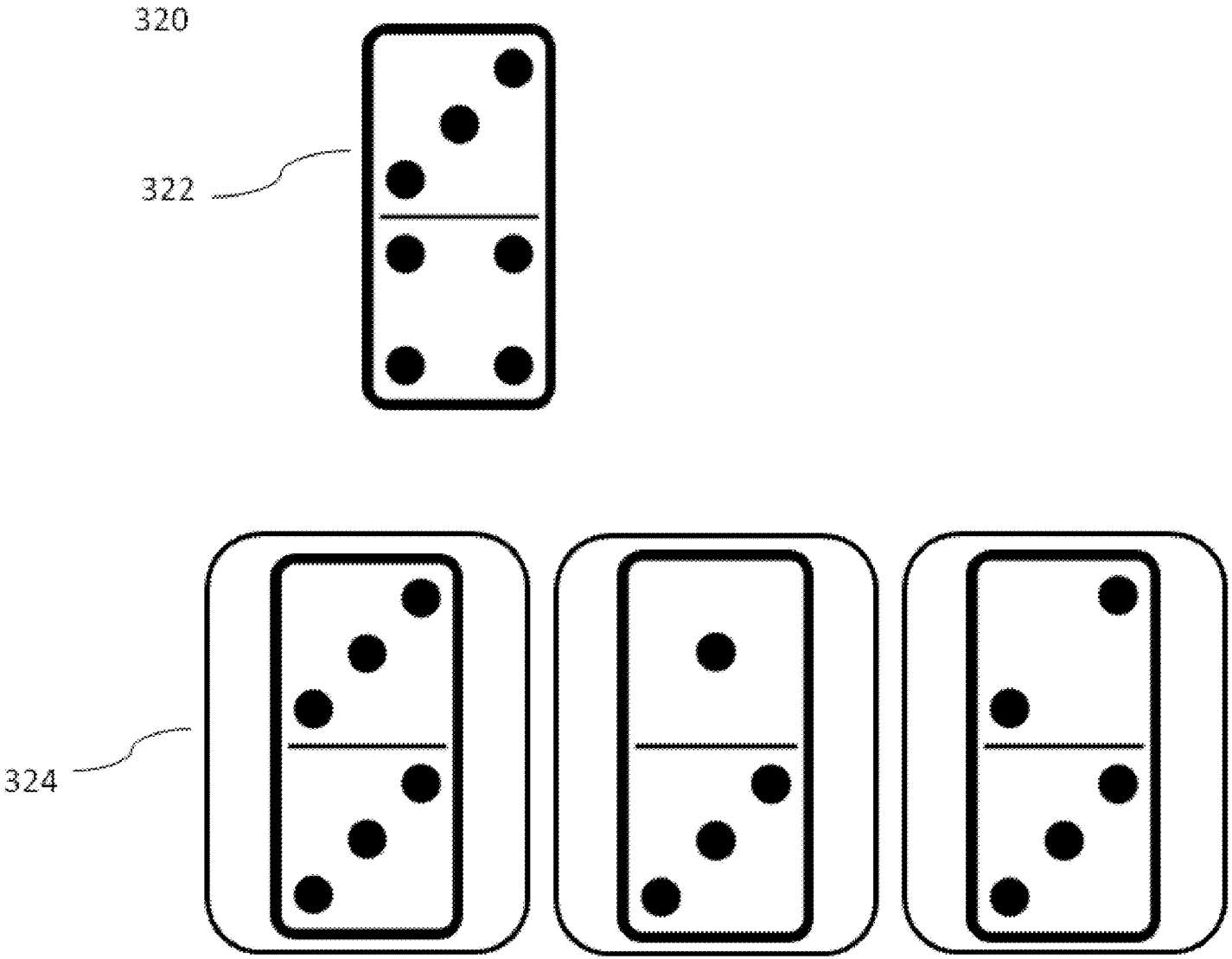
FIG. 9 shows a second screen shot following a selection of the one core domino from FIG. 8 and the provision of three scoring dominoes to be combined with the selected core domino.
Figure 10:
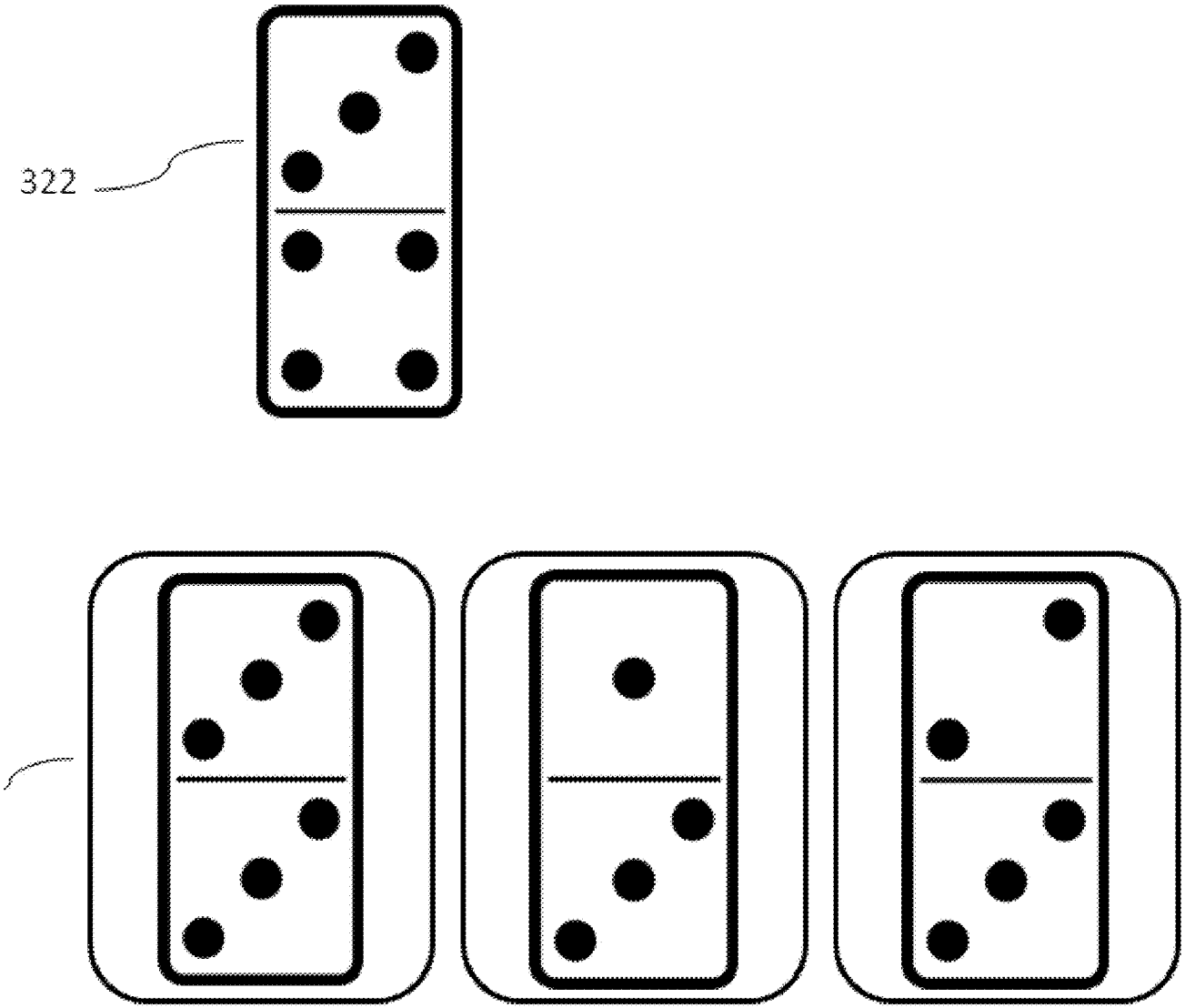
FIG. 10 shows a third screen shot following the selection of the one core domino and the provision of three scoring dominoes in FIG. 9 to be combined with the selected core domino, with scoring shown below the scoring tiles.

In FIG. 9, a screen shot 320 the player has selected to keep the 3-4 domino 322 and discard the 1-2 domino and the 0-3 domino because the 3-4 domino 322 has a greater expected return than the other two options due to the fact that it scores with more of the dominos remaining in the deck and it can score for a bigger point value of 10. Once the player has chosen the connector domino, three random dominos 324 from the remaining deck of 25 are drawn FIG. 10 shows a screen shot 320 that the connector domino 322 selected by the player scores with two out of the three randomly drawn dominos 324. The 3-4 pairs with the 1-3 to make a point total of 5 (the 3 on both dominos connect and the exposed ends are summed: 1'+4=5. The 3-4 also pairs with the 3-3 to make a point total of 5 (the 3 on the 3-4 is placed between the two 3's in the doubles tile (3+3+4=10). Although the 3's do pair on the final dealt domino and the community domino, the total is not a multiple of 5 (4+2=6). The point totals are shown below the tiles 324.

At the conclusion of the hand, all valid scores are summed and the final value of all points is compared to a paytable. The player is awarded the amount that corresponds to the final summed point total.

Alternate Versions of Game:

1: After a winning hand, the bottom row tiles that paired with the community are carried over to the next hand. This introduces new levels of strategy as the play can sometime choose a connector knowing one, two, or all three of the bottom row dominos available to pair.

2: In this variation, the player would see one random half of the three dominoes on the bottom row. This variation would add a new level of skill because the new information could be used to determine which is the best strategy to employ when choosing the connector. For example, if the player sees that all of the exposed halves of the lower level dominoes could potentially pair with the 1-2 domino, the player may select that domino as the connector over other choices.

In FIG. 8 a first screen shot 300 in the game progresses by dealing three random dominos/domino cards 302 (physical or virtual) from a physical or virtual deck of at least 28 unique ranks (and preferably sets of multiples of those 28 unique ranks). The player then selects (must choose) to keep exactly one of the dominoes/domino cards (physical or virtual) and discard the other two. Then an additional at least three random dominoes are provided intro positions 304 as part of the gaming event. The goal is to pair the selected domino with one, two, or all three of the unrevealed dominoes in the row below using traditional all-fives dominos scoring. The player must use strategy to select the domino that pairs with other dominoes more frequently and for bigger values.

In FIG. 9, a screen shot 320 the player has selected to keep the 3-4 domino 322 and discard the 1-2 domino and the 0-3 domino because the 3-4 domino 322 has a greater expected return than the other two options due to the fact that it scores with more of the dominos remaining in the deck and it can score for a bigger point value of 10. Once the player has chosen the connector domino, three random dominos 324 from the remaining deck of 25 are drawn FIG. 10 shows a screen shot 320 that the connector domino 322 selected by the player scores with two out of the three randomly drawn dominos 324. The 3-4 pairs with the 1-3 to make a point total of 5 (the 3 on both dominos connect and the exposed ends are summed: 1'+4=5. The 3-4 also pairs with the 3-3 to make a point total of 5 (the 3 on the 3-4 is placed between the two 3's in the doubles tile (3+3+4=10). Although the 3's do pair on the final dealt domino and the community domino, the total is not a multiple of 5 (4+2=6). The point totals are shown below the tiles 324.

At the conclusion of the hand, all valid scores are summed and the final value of all points is compared to a paytable. The player is awarded the amount that corresponds to the final summed point total.

Alternate Versions of Game:

1: After a winning hand, the bottom row tiles that paired with the community are carried over to the next hand. This introduces new levels of strategy as the play can sometime choose a connector knowing one, two, or all three of the bottom row dominos available to pair.

2: In this variation, the player would see one random half of the three dominoes on the bottom row. This variation would add a new level of skill because the new information could be used to determine which is the best strategy to employ when choosing the connector. For example, if the player sees that all of the exposed halves of the lower level dominoes could potentially pair with the 1-2 domino, the player may select that domino as the connector over other choices.

An (optional) rule that may be executed is described as follows. The player is first initially dealt two, three, or possibly four cards (tiles) face up and chooses which card (tile) to place as the connector. The unselected cards (tiles) are discarded and the remaining cards (tiles) are dealt from the remainder of the deck (set of tiles). This variation introduces an element of strategy and skill to the game as certain domino cards are more valuable than others. This is especially interesting in the execution of an electronic gaming system, where a player can feel as if there is more input and more control. Player buttons or touchscreen input may be used to select the connector card (or tile).

Doubles side bet in the execution of the wagering event changes with multiple sets of playing cards:

That side bet pays when players get 2 or more dominoes in the at least four cards they are dealt (3 card hand and their connector).

Top paying hands include getting the top four doubles (6-6, 5-5, 4-4 and 3-3Maiden's Hand) and getting two pairs of identical doubles (ex: two 3-3's and two 1-1's).

Other variations can be added to the underlying execution of the wagering event.

What is claimed:

1. A method of executing a wagering event including providing a standard set of twenty-eight domino tiles or domino playing cards each of the tiles or cards having two value areas on each face, the tile face values in each value area ranging from 0-6, the tiles have two areas with mixed values equally distributed with face values ranging from 0-0, 0-1, 0-2 . . . 3-6, 4-6, 5-6 and 6-6;

a player position placing a wager on a random outcome event by committing credit at a wagering position, the wager being against conformance between random outcome events with the tiles or domino playing cards with outcome events identified in a paytable;

providing exactly four random domino symbols as the domino cards or the domino tiles to each player position that has made the at least one wager and providing one random domino symbol as a domino tile or domino playing card to a center position on the game table as a single center domino card or single center domino tile;

determining specific types of combinations of tiles in relationships between the single center domino tile or domino playing card and the four player position tiles or playing cards and referencing a paytable chart that details all winning combinations of individual tiles using the four player position tiles with the provided center domino tile; and based on the determined winning combinations, awarding the player position based on payouts in the paytable chart for the at least one wager.

2. The method of claim 1 wherein awards to the player position are based on potential or actual effects of repositioning at least one of the four random domino cards or domino tiles so that at least one set of touching values of at least one value area in a random virtual domino from the player position and at least one value area from the random virtual tile from the center area are identical, and remaining value areas of all repositioned tiles excluding the at least one touching values establishes a collective value of values that are multiples of a specific values between 1 and 5.

3. The method of claim 1 wherein physical domino tiles or physical playing cards with domino tile face images are randomly distributed to the player position and the center position, and a dealer resolves the at least one wager by referencing a paytable chart.

4. The method of claim 3 wherein the dealer awards credit to the player position based on the at least one wager against the paytable when at least two tiles or playing cards form multiples of five when combinations of non-contacting value areas in the tiles after at least two same-value value areas are positioned in contact with each other using two tiles of playing cards.

5. The method of claim 3 wherein a non-standard domino tile or domino playing card is used as the single center domino card or single center domino tile, and that single center domino card or single center domino tile is non-standard because in addition standard domino markings, at least one edge of the single center domino card or single center domino tile has at least one image of a standard domino tile that combines with the single center domino card or single center domino tile to form a winning outcome on the paytable.

6. The method of claim 1 wherein physical domino tiles or physical playing cards with domino tile face images are randomly distributed to the player position and the center position, and a dealer resolves the at least one wager by referencing a paytable chart and/or inputting tile of playing card displayed content into a processor which then evaluates all actual or theoretically repositioned tiles to determine if one or more collective values of multiples of 5 are formed by combinations of value areas in the tiles after at least two same-value value areas are positioned in contact with each other using two tiles of playing cards.

7. The method of claim 6 wherein a paytable indicates an award of credit based on at least one degree of correspondence to the group of correspondence selected from the group consisting of numbers of remaining value areas of all repositioned tiles excluding the at least one actual or virtually touching values which established a collective value of multiples of 5, numbers of remaining value areas of all repositioned tiles excluding the at least one touching values establishes a collective value of multiples of 5 and specifically a 10 value, and numbers of remaining value areas of all repositioned tiles excluding the at least one touching values establishes a collective value of multiples of 5, numbers of specifically 10 and 15, and totals of all configurations of repositioned game tiles each equaling a multiple of 5.

8. The method of claim 1 wherein the one random domino symbol provided as a domino tile or domino playing card to a center position on the game table is provided by: i) providing a first random set of between 2 and 5 multiple dominoes and the player selecting only one of the first random set of between 2 and 5 multiple dominoes as a single core domino to be used in the execution of the wagering event;

providing at least three random dominoes as at least three scoring dominoes displayed to the player position that has made the wager as scoring dominoes;

determining specific types of scoring combinations of dominoes between the single core domino and the at least three scoring dominoes and referencing a paytable chart that details all winning scoring combinations of the single core domino with the at least three scoring dominoes; and based on the determined specific types of winning scoring combinations, awarding the player position based on payouts in the paytable chart for the wager on the random outcome.

9. The method of claim 8 wherein the first random set of between 2 and 5 multiple dominoes consists of two or three random dominoes.

10. The method of claim 9 wherein at least two standard sets of twenty-eight dominoes are provided and wherein awards to the player position are based on scoring combinations between the core domino and the scoring dominoes so that at least one set of compared values of at least one value area in a random core domino from the player position and at least one value area from the scoring dominoes, and remaining value areas of all scoring dominoes establish a collective value of values that are multiples of a specific values between 1 and 5.

11. The method of claim 10 wherein a non-standard domino tile or domino playing card is used as the core domino card or core domino tile, and that single center domino card or single center domino tile is non-standard because in addition standard domino markings, at least one edge of the single core domino card or core domino tile has at least one image of a standard domino tile that combines with the single core domino card or single core domino tile to form a winning outcome on the paytable.

12. The method of claim 8 wherein the first random set of between 2 and 5 multiple dominoes consists of three random dominoes.

13. The method of claim 8 wherein at least two standard sets of twenty-eight dominoes are provided as physical domino tiles or physical playing cards with domino tile face images and a dealer resolves the at least one wager by referencing a paytable chart and all dominoes are point match indicating dominoes.

14. The method of claim 13 wherein a non-standard domino tile or domino playing card is used as the core domino card or core domino tile, and that single center domino card or single center domino tile is non-standard because in addition standard domino markings, at least one edge of the single core domino card or core domino tile has at least one image of a standard domino tile that combines with the single core domino card or single core domino tile to form a winning outcome on the paytable.

15. The method of claim 8 wherein a non-standard domino tile or domino playing card is used as the single center domino card or single center domino tile, and that single center domino card or single center domino tile is non-standard because in addition standard domino markings, at least one edge of the single center domino card or single center domino tile has at least one image of a standard domino tile that combines with the single center domino card or single center domino tile to form a winning outcome on the paytable.

16. The method of claim 15 wherein the paytable used by the processor to resolve wagers defines payout outs as:

| HAND | PAYS |
|---|---|
| Fitted Community Tile plus 4 | At least 100:1 up to 500:1 |
| 4 Fitted Tiles | At least 20:1 up to 50:1 |
| 3 Fitted Tiles | At least 4:1 up to 6:1 |
| 2 Fitted Tiles | At least 3:2 up to 3:1 |
| 1 or 0 Fitted Tiles | −1. |

17. The method of claim 1 wherein at least two standard sets of twenty-eight dominoes are provided as physical domino tiles or physical playing cards with domino tile face images and a dealer resolves the at least one wager by referencing a paytable chart and all dominoes are point match indicating dominoes.

18. The method of claim 17 wherein a non-standard domino tile or domino playing card is used as the core domino card or core domino tile, and that single center domino card or single center domino tile is non-standard because in addition standard domino markings, at least one edge of the single core domino card or core domino tile has at least one image of a standard domino tile that combines with the single core domino card or single core domino tile to form a winning outcome on the paytable.

19. The method of claim 1 wherein a non-standard domino tile or domino playing card is used as the single center domino card or single center domino tile, and that single center domino card or single center domino tile is non-standard because in addition standard domino markings, at least one edge of the single center domino card or single center domino tile has at least one image of a standard domino tile that combines with the single center domino card or single center domino tile to form a winning outcome on the paytable.

20. The method of executing a wagering event of claim 1 on an electronic gaming system comprising a housing, a video display, a processor, memory, player input controls and a value-in-value-out system for entering credit into memory which can be used to place wagers through the player input controls, the wagering event comprising:

a player placing the wager through the player input controls accessing credit stored in memory that has been credited to the electronic gaming system through the value-in-value out system against a paytable based upon correspondence of random domino events as compared to the paytable;

the processor randomly providing from memory four random virtual dominos, each having two value areas of from 0-6 on the two areas, to a player position and one random virtual domino having two value areas of from 0-6 to a center position on the video display;

the player controls are used to reposition at least one of the four random virtual dominos so that at least one touching values of at least one value area in a random virtual domino from the player position and at least one value area from the random virtual tile from the center area are identical, and remaining value areas of all repositioned tiles excluding the at least one touching values establishes a collective value of multiples of 5;

the processor evaluating all repositioned tiles to determine if one or more collective values of multiples of 5 are formed by remaining value areas excluding the at least one touching values, and the processor retaining the at least one wager if no remaining value areas of all repositioned tiles excluding the at least one touching values establishes a collective value of multiples of 5; and the processor awarding credit to the processor based on the at least one wager against the paytable when the at least one wager if no remaining value areas of all repositioned tiles excluding the at least one touching.

* * * * *